US009624055B2

(12) United States Patent
Lee et al.

(10) Patent No.: US 9,624,055 B2
(45) Date of Patent: Apr. 18, 2017

(54) PAPER FEEDING UNIT AND IMAGE FORMING APPARATUS HAVING THE SAME

(71) Applicant: SAMSUNG ELECTRONICS CO., LTD., Suwon-si, Gyeonggi-do (KR)

(72) Inventors: Chang-woo Lee, Suwon-si (KR); Tae-il Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/684,480

(22) Filed: Apr. 13, 2015

(65) Prior Publication Data

US 2015/0344250 A1 Dec. 3, 2015

(30) Foreign Application Priority Data

May 28, 2014 (KR) ..... 10-2014-0064248

(51) Int. Cl.
*B65H 5/26* (2006.01)
*B65H 5/06* (2006.01)

(52) U.S. Cl.
CPC ..... *B65H 5/26* (2013.01); *B65H 5/062* (2013.01); *B65H 2403/40* (2013.01); *B65H 2403/72* (2013.01); *B65H 2403/722* (2013.01); *B65H 2404/16* (2013.01); *B65H 2405/332* (2013.01)

(58) Field of Classification Search
CPC ..... B65H 5/26; B65H 5/06; B65H 2403/72; B65H 2405/332; B65H 2404/16; B65H 2403/40; B65H 2403/722
See application file for complete search history.

(56) References Cited

U.S. PATENT DOCUMENTS 4,577,849 A * 3/1986 Watanabe ..... B65H 3/44 271/10.13
4,744,687 A * 5/1988 Nukaya ..... B41J 13/03 192/71
4,822,019 A * 4/1989 Nagira ..... B65H 3/44 271/110
5,738,453 A * 4/1998 Tsuburaya ..... B65H 3/0661 271/9.13
6,688,590 B2 * 2/2004 Billings ..... B65H 3/44 271/9.05
7,959,147 B2 * 6/2011 Izuchi ..... B65H 3/0669 271/10.03

(Continued)

*Primary Examiner* — Jeremy R Severson
(74) *Attorney, Agent, or Firm* — Staas & Halsey LLP

(57) ABSTRACT

A paper feeding apparatus for an image forming apparatus is provided. The paper feeding apparatus includes a first paper feeding roller, a first one-way rotation transmission member disposed coaxially on the first paper feeding roller to transmit a first one-way rotational force to the first paper feeding roller, a second paper feeding roller spaced apart from the first paper feeding tray, a second one-way rotation transmission member disposed coaxially on the second paper feeding roller to transmit a second one-way rotational force to the second paper feeding roller, a drive source to rotate the first and second paper feeding rollers, a first power transmission member disposed between the first one-way rotation transmission member and the drive source, and a second power transmission member disposed between the second one-way rotation transmission member and the drive source.

20 Claims, 18 Drawing Sheets

(56) References Cited

U.S. PATENT DOCUMENTS

| | | | | |
|---|---|---|---|---|
| 7,980,547 | B2 * | 7/2011 | Ito | B65H 3/0684 271/117 |
| 8,672,315 | B2 * | 3/2014 | Goto | B65H 5/06 271/9.01 |
| 2010/0230891 | A1 * | 9/2010 | Omata | B65H 3/5269 271/10.09 |

* cited by examiner

PAPER FEEDING UNIT AND IMAGE FORMING APPARATUS HAVING THE SAME

CROSS-REFERENCE TO RELATED APPLICATIONS

This application claims priority from Korean Patent Application No. 10-2014-0064248 filed May 28, 2014 in the Korean Intellectual Property Office, the disclosure of which is incorporated herein by reference in its entirety.

BACKGROUND

1. Field

The present disclosure relates to a paper feeding apparatus. More particularly, the present disclosure relates to a paper feeding apparatus that can selectively supply a print medium from two paper feeding trays using a single motor and an image forming apparatus having the same.

2. Description of the Related Art

Image forming apparatuses including two or more paper feeding trays have been widely used.

In general, a conventional image forming apparatus including two paper feeding trays includes two pickup rollers and two feed rollers in order to pick up and convey print media loaded in each of the two paper feeding trays. Accordingly, the conventional image forming apparatus including the two paper feeding trays controls a rotational force being transmitted to the pickup roller and the feed roller of each of the two paper feeding trays to supply the print medium selectively from the two paper feeding trays to the image forming unit. Accordingly, the conventional image forming apparatus supplies the print medium in one of the two paper feeding trays to the image forming unit by controlling the pickup roller and the feed roller in a variety of ways.

For example, a single motor may be configured to drive two feed rollers disposed in the two paper feeding trays at the same time. In this case, a pickup roller disposed in each of the two paper feeding trays selectively picks up the print medium so that, even when the two feed rollers are rotated at the same time, the print medium picked up from only one of the two paper feeding trays is supplied to the image forming unit.

However, in such a structure, because the single motor rotates also the feed roller disposed in the paper feeding tray which does not need to supply the print medium, a large motor capacity that can drive the two feed rollers is required. Accordingly, there are problems that arise such as an increase in material cost resulting in increased manufacturing cost and increased noise. Also, power consumption is increased due to the rotation of the unnecessary feed roller, and the life of parts associated with the rotation of the feed roller, such as a feed roller, a shaft, a bush, etc., is reduced resulting in increased maintenance costs.

As another example, the two feed roller may be configured to be selectively driven using one motor and two electronic clutches. In detail, when the print medium is supplied from a first paper feeding tray, a first electronic clutch disposed at a first feed roller of the first paper feeding tray supplies power of the motor to the first feed roller, and a second electronic clutch disposed at a second feed roller of a second paper feeding tray blocks the power of the motor from being supplied to the second feed roller. On the contrary, when the print medium is supplied from the second paper feeding tray, the first electronic clutch disposed at the first feed roller of the first paper feeding tray blocks the power of the motor from being supplied to the first feed roller, and the second electronic clutch disposed at the second feed roller of the second paper feeding tray supplies the power of the motor to the second feed roller.

However, for such a structure, the two electronic clutches are required for the operation control of the two feed rollers. Accordingly, the power consumption is large because of the operation of the electronic clutch, and there is a risk of malfunction of the electronic clutch. Also, since the electronic clutch and additional space for installation of the electronic clutch are needed, there is a problem that the material cost is increased.

As another example, the two feed rollers may be configured to be driven separately by two motors. In detail, when the print medium is supplied from the first paper feeding tray, a first motor is driven to rotate the first feed roller and a second motor for the second feed roller is hold stationary. When the print medium is supplied from the second paper feeding tray, the second motor is driven to rotate the second feed roller and the first motor for the first feed roller is hold stationary.

However, for such a structure, since the additional motor and a space for installation of the additional motor are needed due to usage of the two motors compared to the case in which a single motor is used, there is a problem that the material cost is increased.

Accordingly, development of a paper feeding apparatus that can selectively supply a print medium from two paper feeding trays using a single motor and that can minimize the material cost and installation space has been identified as desirable by the inventors of the present disclosure.

SUMMARY

The present disclosure has been developed in order to overcome the above drawbacks and other problems associated with the conventional arrangement. An aspect of the present disclosure relates to a paper feeding apparatus that can selectively supply a print medium from two paper feeding trays using a single motor and can minimize material cost and installation space, and an image forming apparatus having the same.

The above aspect and/or other features of the present disclosure can substantially be achieved by providing a paper feeding apparatus for an image forming apparatus, which may include a first paper feeding roller to convey a print medium loaded in a first paper feeding tray; a first one-way rotation transmission member disposed coaxially on the first paper feeding roller to transmit an one-way rotational force to the first paper feeding roller; a second paper feeding roller to convey a print medium loaded in a second paper feeding tray disposed to be spaced apart from the first paper feeding tray; a second one-way rotation transmission member disposed coaxially on the second paper feeding roller to transmit an one-way rotational force to the second paper feeding roller; a drive source for generating a rotational force to rotate the first and second paper feeding rollers; a first power transmission member disposed between the first one-way rotation transmission member and the drive source, the first power transmission member to transmit power of the drive source to the first one-way rotation transmission member; and a second power transmission member disposed between the second one-way rotation transmission member and the drive source, the second power transmission member to transmit the power of the drive source to the second one-way rotation transmission member, wherein when the drive source rotates in one direction, the first paper feeding roller conveys the print medium from the first paper feeding tray by the first one-way rotation transmission member, and when the drive source rotates in an opposite direction, the second paper feeding roller conveys the print medium from the second paper feeding tray by the second one-way rotation transmission member.

The first paper feeding tray may be disposed parallel to the second paper feeding tray above the second paper feeding tray.

A rotational direction of a drive force which the first power transmission member transmits to the first one-way rotation transmission member may be opposite to the rotational direction of the drive force which the second power transmission member transmits to the second one-way rotation transmission member.

The paper feeding apparatus for an image forming apparatus may include a conveying roller disposed to be rotated in the same direction as the second paper feeding roller, the conveying roller to convey the print medium being fed by the second paper feeding roller.

The second paper feeding tray may be arranged to face the first paper feeding tray in one side of the first paper feeding tray, and the first paper feeding roller and the second paper feeding roller are disposed to feed the print medium in a direction opposite to each other.

A rotational direction of the drive force which the first power transmission member transmits to the first one-way rotation transmission member may be the same as the rotational direction of the drive force which the second power transmission member transmits to the second one-way rotation transmission member.

The paper feeding apparatus for an image forming apparatus may include an idle roller disposed to be in contact with each of the first paper feeding roller and the second paper feeding roller and facing each of the first paper feeding roller and the second paper feeding roller.

Each of the first paper feeding roller and the second paper feeding roller may include at least one of a pickup roller and a feed roller.

The second paper feeding tray may include a manual paper feeding unit.

Each of the first power transmission member and the second power transmission member may include one of a gear structure, a belt structure, and a mixed structure of gears and a belt.

The drive source may include a motor capable of bi-directional rotation.

According to another aspect of the present disclosure, an image forming apparatus may include a plurality of paper feeding trays to receive print media; an image forming unit to form an image on a print medium; at least one paper feeding apparatus configured to supply the image forming unit with a print medium received in one of the two adjacent paper feeding trays among the plurality of paper feeding trays; and a paper discharging unit to discharge the print medium on which an image is formed by the image forming unit outside, wherein the at least one of paper feeding apparatus comprises, a first paper feeding roller disposed in a first paper feeding tray among the plurality of paper feeding trays, the first paper feeding roller to convey a print medium loaded in the first paper feeding tray; a first one-way rotation transmission member disposed coaxially on the first paper feeding roller to transmit an one-way rotational force to the first paper feeding roller; a second paper feeding roller disposed in a second paper feeding tray adjacent to the first paper feeding tray among the plurality of paper feeding trays, the second paper feeding roller to convey a print medium loaded in the second paper feeding tray; a second one-way rotation transmission member disposed coaxially on the second paper feeding roller to transmit an one-way rotational force to the second paper feeding roller; a drive source for generating a rotational force capable of rotating the first paper feeding roller and the second paper feeding roller; a first power transmission member disposed between the first one-way rotation transmission member and the drive source, the first power transmission member to transmit power of the drive source to the first one-way rotation transmission member; and a second power transmission member disposed between the second one-way rotation transmission member and the drive source, the second power transmission member to transmit the power of the drive source to the second one-way rotation transmission member, wherein when the drive source rotates in one direction, the first paper feeding roller conveys the print medium from the first paper feeding tray by the first one-way rotation transmission member, and when the drive source rotates in an opposite direction, the second paper feeding roller conveys the print medium from the second paper feeding tray by the second one-way rotation transmission member.

When a number of the plurality of paper feeding trays is 2N, a number of the drive sources of the plurality of paper feeding apparatuses may be N.

The plurality of paper feeding trays may be disposed in a stacked structure in a vertical direction.

A rotational direction of a rotational force which the first power transmission member transmits to the first one-way rotation transmission member may be opposite to the rotational direction of the rotational force which the second power transmission member transmits to the second one-way rotation transmission member.

The plurality of paper feeding trays may include a first paper feeding tray disposed inside a main body of the image forming apparatus and a second paper feeding tray disposed outside the main body facing the first paper feeding tray, and wherein the first paper feeding roller of the paper feeding apparatus is disposed to feed the print medium loaded in the first paper feeding tray, and the second paper feeding roller of the paper feeding apparatus is disposed to feed the print medium loaded in the second paper feeding tray.

The plurality of paper feeding trays may include at least one pair of paper feeding trays in which two paper feeding trays are disposed to face each other, and the first paper feeding roller of the paper feeding apparatus is disposed to feed the print medium loaded in one of the pair of paper feeding trays, and the second paper feeding roller of the paper feeding apparatus is disposed to feed the print medium loaded in the other of the pair of paper feeding trays.

A rotational direction of a rotational force which the first power transmission member transmits to the first one-way rotation transmission member may be the same as the rotational direction of the rotational force which the second power transmission member transmits to the second one-way rotation transmission member.

Each of the first paper feeding roller and the second paper feeding roller may include at least one of a pickup roller and a feed roller.

Each of the first power transmission member and the second power transmission member may include one of a gear structure, a belt structure, and a mixed structure of gears and a belt.

According to another aspect of the present disclosure, an image forming apparatus may include first and second paper feeding trays to receive print media; a paper feeding apparatus configured to selectively pickup and supply a print medium received in one of the first and second paper feeding trays; and a drive source configured to transmit a rotational force to the paper feeding apparatus, wherein the drive source rotates in a clockwise direction or in a counterclockwise direction, and the paper feeding apparatus selectively picks up the print medium received in one of the first and second paper feeding trays according to a rotation direction of the drive source.

The paper feeding apparatus may include first and second paper feeding rollers that correspond to each of the first and second paper feeding trays and pick up the print medium, and wherein the first paper feeding roller receives a rotational force from the drive source through a first one-way rotation transmission member that can transmit a clockwise rotational force, and the second paper feeding roller receives the rotational force from the drive source through a second one-way rotation transmission member that can transmit a counterclockwise rotational force.

The paper feeding apparatus may include first and second paper feeding rollers that correspond to each of the first and second paper feeding trays and pick up the print medium; first and second power transmission members configured to supply the rotational force of the drive source to each of the first and second paper feeding rollers; a first one-way rotation transmission member disposed between the first paper feeding roller and the first power transmission member; and a second power transmission member disposed between the second paper feeding roller and the second power transmission member, wherein when the drive source rotates in a clockwise direction, the first paper feeding roller is rotated by the first one-way rotation transmission member, and an input portion of the second one-way rotation transmission member is rotated, and when the drive source rotates in a counterclockwise direction, the second paper feeding roller is rotated by the second one-way rotation transmission member, and an input portion of the first one-way rotation transmission member is rotated.

Each of the first and second one-way rotation transmission member may include an one-way clutch.

According to another aspect of the present disclosure, a paper feeding apparatus of an image forming apparatus may include a first paper feeding roller to convey a print medium loaded in a first paper feeding tray, a second paper feeding roller to convey a print medium loaded in a second paper feeding tray disposed separate from the first paper feeding tray, a first one-way rotation transmission member disposed on the first paper feeding roller to transmit a first one-way rotational force to the first paper feeding roller, a second one-way rotation transmission member disposed on the second paper feeding roller to transmit a second one-way rotational force to the second paper feeding roller, and a drive source for generating a rotational force to rotate the first and second paper feeding rollers, wherein when the drive source rotates in a first direction, the first paper feeding roller conveys the print medium from the first paper feeding tray with the first one-way rotation transmission member, and when the drive source rotates in a direction opposite to the first direction, the second paper feeding roller conveys the print medium from the second paper feeding tray with the second one-way rotation transmission member.

According to another aspect of the present disclosure, a method of selectively picking up and supplying a print medium in one of a first and second paper feeding tray in an image forming apparatus is described. The method may include transmitting a rotational force to a paper feeding apparatus using a drive source, and alternatively rotating the drive source in a first direction to pick up print medium from the first paper feeding tray and rotating the drive source in a second direction, opposite of the first direction, to pick up the print medium from the second paper feeding tray.

Other objects, advantages and salient features of the present disclosure will become apparent from the following detailed description, which, taken in conjunction with the annexed drawings, discloses preferred embodiments.

BRIEF DESCRIPTION OF THE DRAWINGS

These and/or other aspects and advantages of the present disclosure will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION

Hereinafter, certain exemplary embodiments of the present disclosure will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

Figure 1:
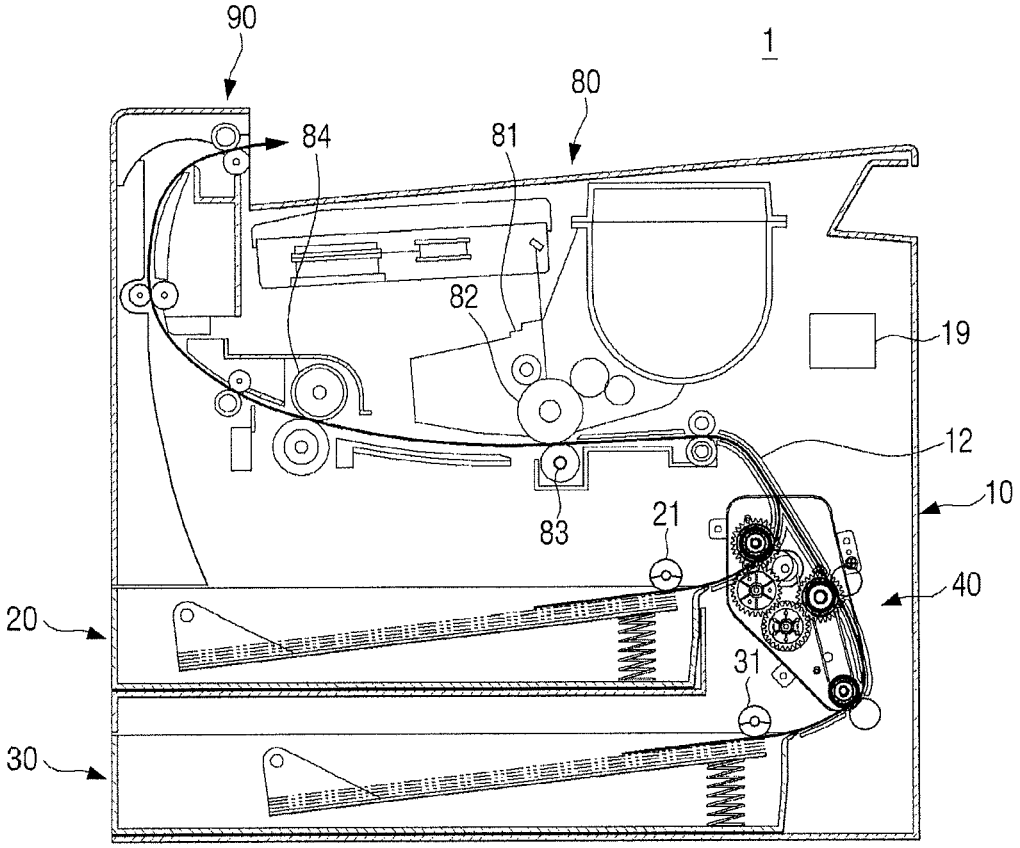
FIG. 1 is a cross-sectional view schematically illustrating an image forming apparatus including a paper feeding apparatus according to a first embodiment of the present disclosure.
Figure 2:
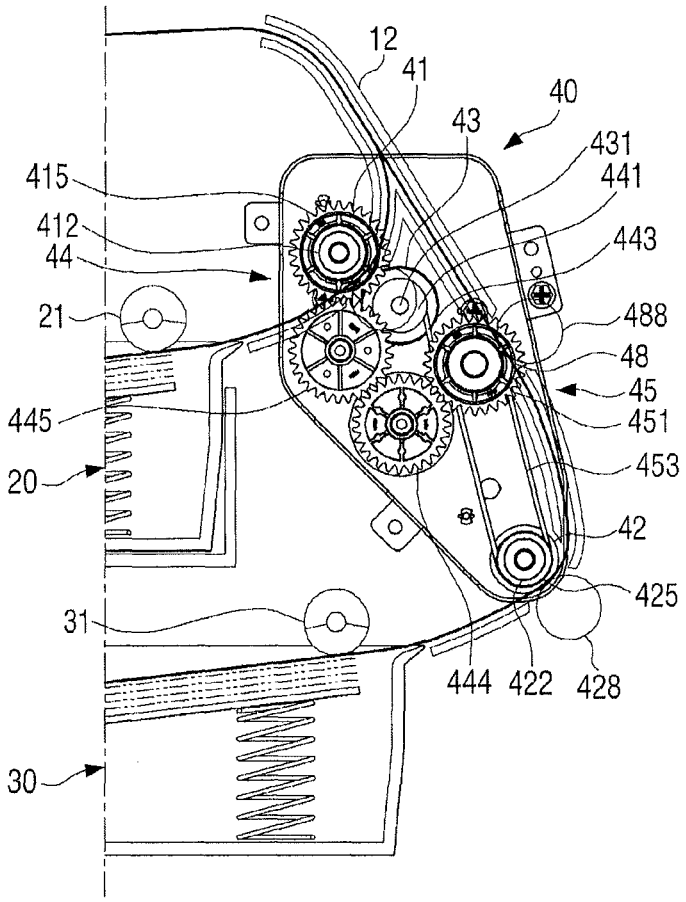
FIG. 2 is a partial cross-sectional view illustrating the paper feeding apparatus of FIG. 1.
Figure 3:
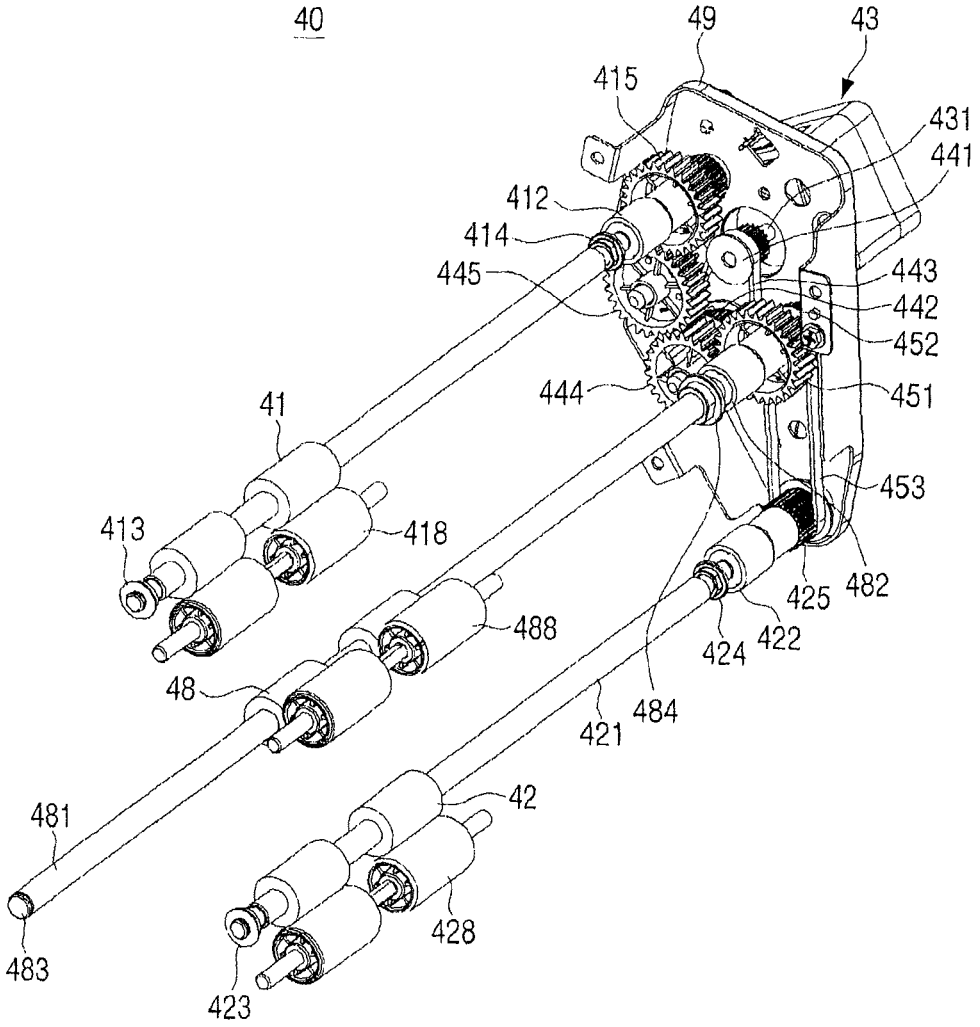
FIG. 3 is a perspective view illustrating the paper feeding apparatus of FIG. 1.
Figure 4A:
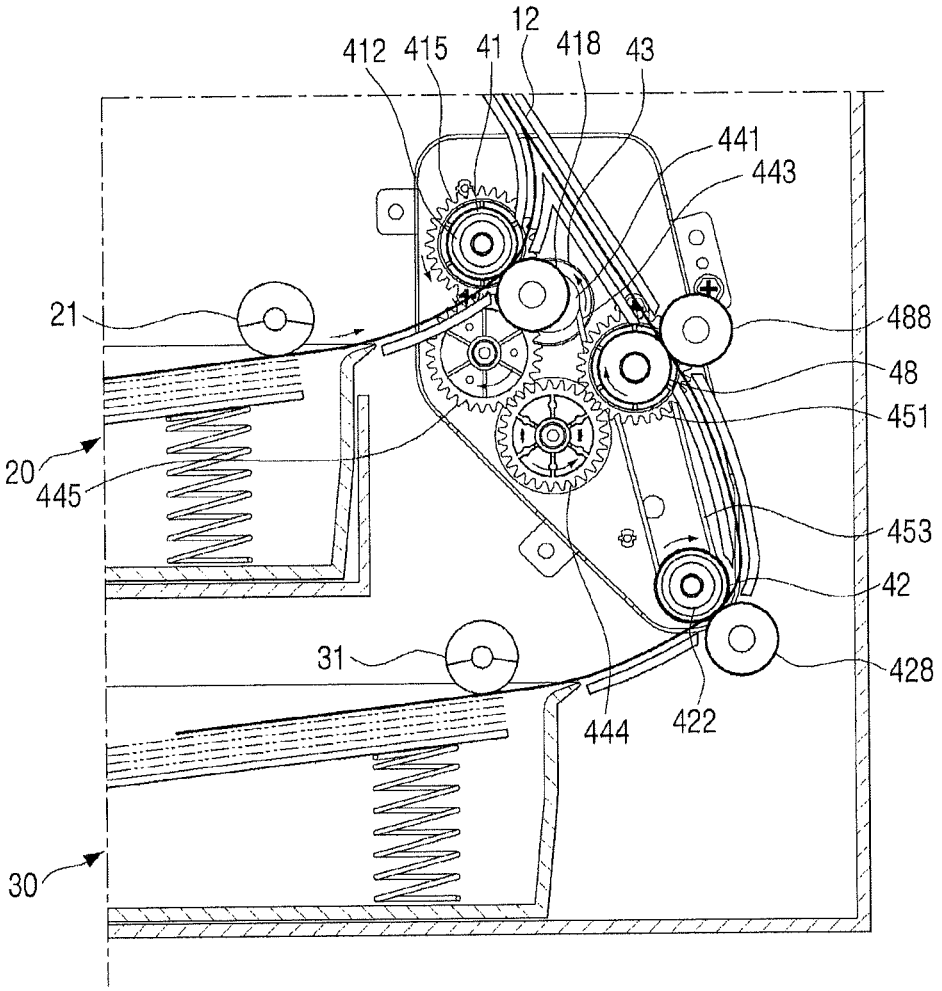
FIG. 4A is a partial cross-sectional view illustrating when a first paper feeding tray of the paper feeding apparatus of FIG. 1 supplies a print medium.
Figure 4B:
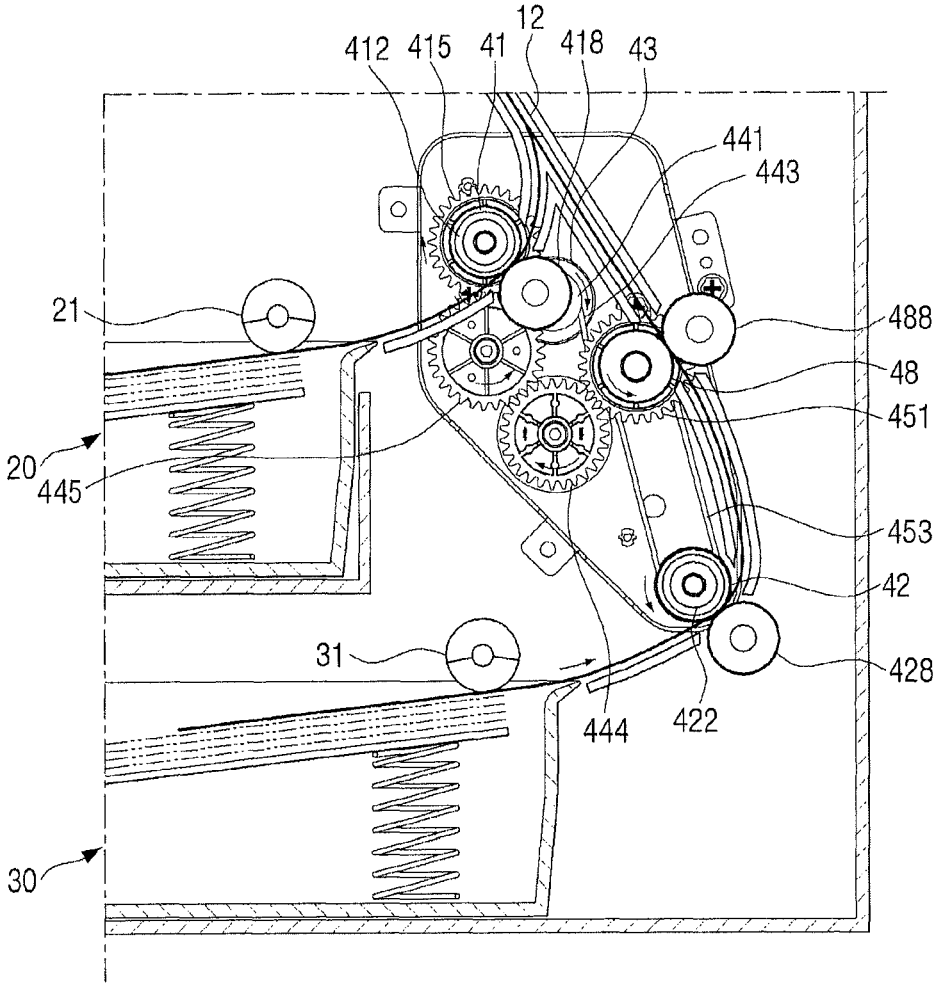
FIG. 4B is a partial cross-sectional view illustrating when a second paper feeding tray of the paper feeding apparatus of FIG. 1 supplies a print medium.

FIG. 1 is a cross-sectional view schematically illustrating an image forming apparatus including a paper feeding apparatus according to a first embodiment of the present disclosure. FIG. 2 is a partial cross-sectional view illustrating the paper feeding apparatus of FIG. 1, and FIG. 3 is a perspective view illustrating the paper feeding apparatus of FIG. 1. FIG. 4A is a partial cross-sectional view illustrating when a first paper feeding tray of the paper feeding apparatus of FIG. 1 supplies a print medium, and FIG. 4B is a partial cross-sectional view illustrating when a second paper feeding tray of the paper feeding apparatus of FIG. 1 supplies a print medium.

Referring to FIG. 1, an image forming apparatus 1 according to an embodiment of the present disclosure may include, for example, a main body 10, two paper feeding trays 20 and 30, an image forming unit 80, a paper discharging unit 90, and a paper feeding apparatus 40.

The main body 10 forms an appearance of the image forming apparatus 1, and accommodates and supports the two paper feeding trays 20 and 30, the image forming unit 70, the paper discharging unit 80, and the paper feeding apparatus 40 therein.

Figure 5:
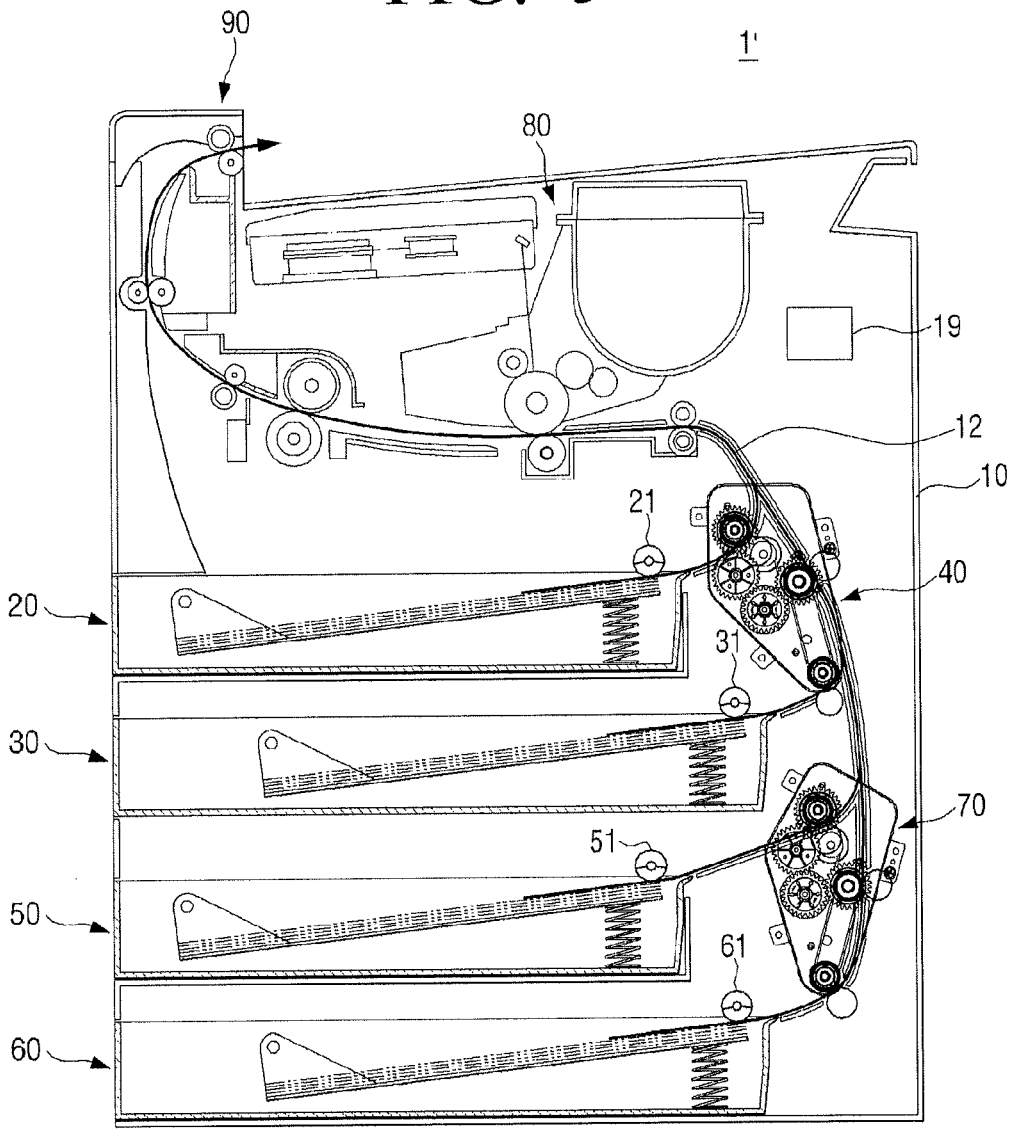
FIG. 5 is a cross-sectional view schematically illustrating an image forming apparatus including two paper feeding apparatuses according to a first embodiment of the present disclosure.

Each of the paper feeding trays 20 and 30 accommodates a predetermined number of print media, such as paper, and supports the print media so that the paper feeding apparatus 40 supplies the print media to the image forming unit 80 one-by-one. The image forming apparatus 1 according to an embodiment of the present disclosure may include a plurality of paper feeding trays 20 and 30, in detail, two or more paper feeding trays 20 and 30. For example, as illustrated in FIG. 1, the image forming apparatus 1 includes two paper feeding trays 20 and 30, or an image forming apparatus 1', as illustrated in FIG. 5, may include four paper feeding trays 20, 30, 50, and 60. The paper feeding trays 20, 30, 50, and 60 may be formed in a paper feeding cassette shape or in a manual paper feeding unit shape. However, in the present embodiment, the paper feeding trays that are formed in the paper feeding cassette shape are used.

The image forming unit 80 forms a predetermined image on the print medium supplied from the paper feeding trays 20 and 30. The image forming unit 80 may include a developing unit 81 to form a developer image on an image carrier 82, a transfer unit 83 to transfer the developer image formed on the image carrier 82 onto the print medium, and a fixing unit 84 to fix the transferred developer image onto the print medium. The image forming unit 80 may be the same as or similar to the image forming unit of a conventional image forming apparatus; therefore, a detailed description thereof will be omitted. Also, the present disclosure may be applied to a paper feeding apparatus for an inkjet printer. Accordingly, although not illustrated, the image forming unit may be configured of an ink spray head to spray a predetermined ink according to printing data.

The paper discharging unit 90 discharges the print medium on which the predetermined image is formed while passing through the image forming unit 80 outside the main body 10 of the image forming apparatus 1. The paper discharging unit 90 may be configured of a pair of discharging rollers. The paper discharging unit 90 may be the same as or similar to the paper discharging unit of a conventional image forming apparatus and therefore, a detailed description thereof will be omitted.

The paper feeding apparatus 40 is formed to supply the image forming unit 80 with the print media accommodated in one of the two paper feeding trays 20 and 30. The paper feeding apparatus 40 according to an embodiment of the present disclosure is disposed corresponding to the number of the paper feeding trays 20 and 30. In detail, one paper feeding apparatus 40 is provided per two paper feeding trays 20 and 30. For example, when the two paper feeding trays 20 and 30 are disposed in the image forming apparatus 1 as illustrated in FIG. 1, one paper feeding apparatus 40 is provided in the image forming apparatus 1. When four paper feeding trays 20, 30, 50, and 60 are provided in the image forming apparatus 1' as illustrated in FIG. 5, two paper feeding apparatuses 40 and 70 are provided in the image forming apparatus 1'. Although not illustrated, if six paper feeding trays are provided in the image forming apparatus 1, the image forming apparatus 1 includes three paper feeding apparatuses, and so on. Accordingly, if 2N paper feeding trays are disposed in the image forming apparatus 1, N paper feeding apparatus(es) 40 are disposed in the image forming apparatus 1. Here, N presents a natural number.

Referring to FIGS. 2 and 3, the paper feeding apparatus 40 may include a first paper feeding roller 41, a second paper feeding roller 42, a drive source 43, a first power transmission member 44, and a second power transmission member 45.

The first paper feeding roller 41 is disposed in a first paper feeding tray 20, and moves the print medium loaded on the first paper feeding tray 20 toward the image forming unit 80. The first paper feeding roller 41 is a roller that is used to move the print medium loaded on the first paper feeding tray 20 toward the image forming unit 80, and may be a pickup roller 21 to pick up the print media loaded on the first paper feeding tray 20 one by one or a feed roller 41 to move the print medium picked up by the pickup roller 21 toward the image forming unit 80.

The second paper feeding roller 42 is disposed in a second paper feeding tray 30, and moves the print medium loaded on the second paper feeding tray 30 toward the image forming unit 80. The second paper feeding roller 42 is a roller that is used to move the print medium loaded on the second paper feeding tray 30 toward the image forming unit 80, and may be a pickup roller 31 or a feed roller 42 in the same as the first paper feeding roller 41. However, in an embodiment of the present disclosure, the first paper feeding roller 41 and the second paper feeding roller 42 are formed of rollers having the same function. For example, if the first paper feeding roller 41 is a pickup roller, the second paper feeding roller 42 also is formed as a pickup roller. Alternatively, if the first paper feeding roller 41 is a feed roller, the second paper feeding roller 42 is also formed as a feed roller.

Figure 6A:
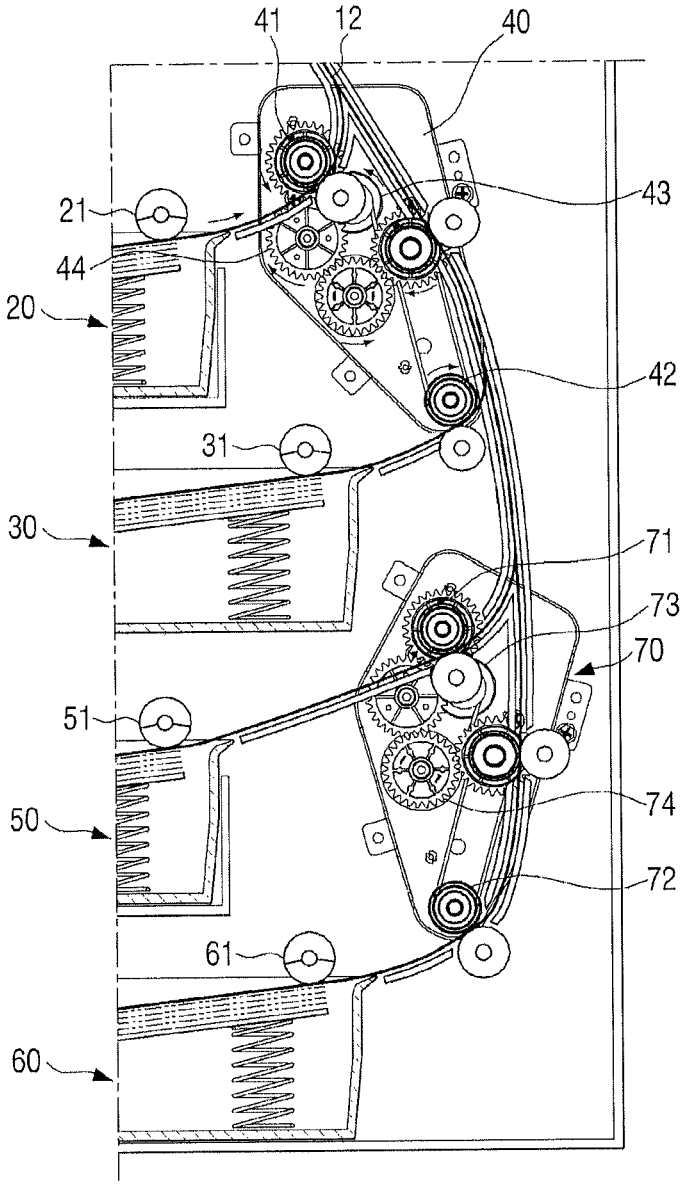
FIG. 6A is a partial cross-sectional view illustrating when a first paper feeding tray of the paper feeding apparatus of FIG. 5 supplies a print medium.

For reference, FIGS. 1 to 6B illustrate the first embodiment of the paper feeding apparatus 40 in which the first and second paper feeding rollers 41 and 42 are feed rollers. FIG. 7 illustrates an embodiment of the paper feeding apparatus in which the first and second paper feeding rollers 41 and 42 are pickup rollers.

Hereinafter, the paper feeding apparatus 40 according to a first embodiment of the present disclosure in which the first and second paper feeding rollers 41 and 42 are feed rollers will be described in detail with reference to FIGS. 1 to 4B.

Referring to FIGS. 2 and 3, the first paper feeding roller 41 is disposed on a first shaft 411, and a first gear 415 is disposed at an end of the first shaft 411. The first paper feeding roller 41 may include two rollers disposed apart from each other, and is disposed to rotate in contact with a first idle roller 418. A first one-way rotation transmission member 412 is disposed between the first gear 415 and the first shaft 411. Accordingly, the first paper feeding roller 41 is disposed coaxially with the first one-way rotation transmission member 412. In detail, the first shaft 411 is rotatably supported by a pair of bushes 413 and 414, and the first paper feeding roller 41 is disposed coaxially on the first shaft 411. One bush 413 is disposed near the first paper feeding roller 41 at one end of the first shaft 411, and the other bush 414 is disposed to support the first shaft 411 near the first one-way rotation transmission member 412. The pair of bushes 413 and 414 is fixed to a frame (not illustrated) provided inside the main body 10 of the image forming apparatus 1, and rotatably supports the first shaft 411.

The first one-way rotation transmission member 412 is a mechanical component that can deliver only one-way rotation, and may include a one-way clutch, a one-way bearing, a one-way clutch bearing, etc. The first one-way rotation transmission member 412 has a structure in which the rotational force is output through an output portion thereof, only when a predetermined direction of rotational force is input into an input portion thereof. For example, if the first one-way rotation transmission member 412 has a structure capable of transmitting a clockwise rotational force, when the clockwise rotational force is input to the input portion of the first one-way rotation transmission member 412, the clockwise rotational force is transmitted to the output portion. On the contrary, when a counterclockwise rotational force is input to the input portion of the first one-way rotation transmission member 412, only the input portion is rotated, but not the output portion. In the present embodiment, a first one-way clutch is used as the first one-way rotation transmission member 412. Accordingly, hereinafter, a one-way clutch will be described as one example of the first one-way rotation transmission member 412.

An inner ring of the first one-way clutch 412 is fixed to the first shaft 411, and an outer ring thereof is fixed to the first gear 415. Accordingly, when the first gear 415 rotates, the outer ring of the first one-way clutch 412 is rotated in the same direction as that of the first gear 415. However, the inner ring of the first one-way clutch 412 is rotated integrally with the outer ring only when the outer ring is rotated in one direction. But, when the outer ring is rotated in the opposite direction, the inner ring maintains a stopped state without being rotated together with the outer ring. For example, the first one-way clutch 412 may be disposed so that when the outer ring of the first one-way clutch 412 is rotated in the counterclockwise direction, the inner ring of the first one-way clutch 412 is rotated together with the outer ring in the counterclockwise direction, and when the outer ring is rotated in the clockwise direction, the inner ring is in a stationary state without being rotated together with the outer ring and only the outer ring being rotated.

In the present embodiment, the outer ring of the first one-way clutch 412 is connected directly to the first gear 415. Alternatively, the first one-way clutch 412 may be formed in a structure in which the outer ring thereof is fixed to a coupler (not illustrated), and the coupler is connected to the first gear 415. In this case, when the first gear 415 rotates, the coupler is rotated. Then, when the coupler is rotated, the outer ring of the first one-way clutch 412 is rotated. It is the same as the above description that the inner ring of the first one-way clutch 412 is rotated or is not rotated depending on the rotational direction of the outer ring of the first one-way clutch 412.

The second paper feeding roller 42 is disposed on a second shaft 421, and a first pulley 425 is disposed at one end of the second shaft 421. The second paper feeding roller 42 may include two rollers disposed to be spaced apart from each other, and is disposed to rotate in contact with a second idle roller 428. A second one-way rotation transmission member 422 is disposed between the first pulley 425 and the second shaft 421. Accordingly, the second paper feeding roller 42 is disposed coaxially with the second one-way rotation transmission member 422. In detail, the second shaft 421 is rotatably supported by a pair of bushes 423 and 424, and the second paper feeding roller 42 is disposed coaxially in the second shaft 421. One bush 423 is disposed near the second paper feeding roller 42 at one end of the second shaft 421, and the other bush 424 is disposed to support the second shaft 421 near the second one-way rotation transmission member 422. The pair of bushes 423 and 424 is fixed to the frame (not illustrated) provided inside the main body 10 of the image forming apparatus 1, and rotatably supports the second shaft 421.

The second one-way rotation transmission member 422 is a mechanical component that can deliver only one-way rotation, and has the same structure as that of the first one-way rotation transmission member 412. In the present embodiment, a second one-way clutch is used as the second one-way rotation transmission member 422. Accordingly, hereinafter, a one-way clutch will be described as one example of the second one-way rotation transmission member 422.

An inner ring of a second one-way clutch 422 is fixed to the second shaft 421, and an outer ring thereof is fixed to the first pulley 425. Accordingly, when the first pulley 425 rotates, the outer ring of the second one-way clutch 422 is rotated. The inner ring of the second one-way clutch 422 may be rotated integrally with the outer ring or may maintain the stopped state without being rotated together with the outer ring depending on the rotational direction of the outer ring. The installation structure and operation of the inner ring and the outer ring of the second one-way clutch 422 are the same as those of the first one-way clutch 412 as described above and therefore, detailed description thereof will be omitted.

The drive source 43 generates a driving force that can rotate the first paper feeding roller 41 and the second paper feeding roller 42. A motor capable of bi-directional rotation may be used as the drive source 43. The motor 43 is fixed to a motor bracket 49 which is secured to the main body frame (not illustrated). A motor shaft 431 of the motor 43 may provided with a pinion gear or a drive pulley 441.

The first power transmission member 44 is configured to transmit the rotational force of the drive source 43 to the first shaft 413 in which the first paper feeding roller 41 is disposed. In detail, the first power transmission member 44 may include the drive pulley 441 disposed in the shaft 431 of a motor that is the drive source 43, an intermediate pulley 442, a first belt 443 connecting the drive pulley 441 and the intermediate pulley 442, an intermediate gear 444 disposed coaxially and integrally with the intermediate pulley 442, and a second gear 445 disposed to be engaged with the intermediate gear 444. The second gear 445 is engaged with the first gear 415 disposed in the first shaft 411. Here, the first belt 443 transmitting the rotational force of the drive pulley 441 to the intermediate pulley 442 may use a timing belt. The drive pulley 441 and the intermediate pulley 442 may use a timing pulley. Accordingly, when the motor 43 rotates, the drive pulley 441 is rotated. When the drive pulley 441 is rotated, the intermediate pulley 442 is rotated by the first belt 443. When the intermediate pulley 442 is rotated, the intermediate gear 444 formed integrally with the intermediate pulley 442 is rotated. When the intermediate gear 444 is rotated, the second gear 445 engaged with the intermediate gear 444 is rotated, and when the second gear 445 is rotated, the first gear 415 is rotated. When the first gear 415 is rotated, the outer ring of the first one-way clutch 412 connected to the first gear 415 is rotated.

In the present embodiment, the intermediate gear 444 is configured to receive the power from the motor 43 through the first belt 443. Alternatively, the intermediate gear 444 may be configured to be connected directly to the shaft 431 of the motor 43. Also, in this embodiment, when the shaft 431 of the motor 43 rotates in the counterclockwise direction, the inner ring of the first one-way clutch 412 is rotated together with the outer ring, thereby rotating the first shaft 411. Accordingly, when the shaft 431 of the motor 43 rotates in the counterclockwise direction, the first paper feeding roller 41 is rotated in the counterclockwise direction to convey the print medium from the first paper feeding tray 20.

The second power transmission member 45 is configured to transmit the rotational force of the drive source 43 to the second shaft 421 in which the second paper feeding roller 42 is disposed. In detail, the second power transmission member 45 may include the drive pulley 441 disposed in the shaft 431 of the motor that is the drive source 43, the intermediate pulley 442, the first belt 443 connecting the drive pulley 441 and the intermediate pulley 442, the intermediate gear 444 disposed coaxially and integrally with the intermediate pulley 442, a third gear 451 disposed to be engaged with the intermediate gear 444, and a second pulley 452 disposed coaxially and integrally with the third gear 451. The second pulley 452 is connected to the first pulley 425 through a second belt 453. Here, the second belt 453 transmitting the rotational force of the second pulley 452 to the first pulley 425 may use a timing belt. The first pulley 425 and the second pulley 452 may use a timing pulley. The power transmission structure from the drive pulley 441 to the intermediate gear 444 uses in common the same as the above described first power transmission member 44. Accordingly, since the intermediate gear 444 is engaged with the second gear 445 and the third gear 451, when the intermediate gear 444 is rotated, the second gear 445 and the third gear 451 are rotated at the same time. In detail, when the motor 43 rotates, the drive pulley 441 is rotated. When the drive pulley 441 is rotated, the intermediate pulley 442 is rotated by the first belt 443. When the intermediate pulley 442 is rotated, the intermediate gear 444 formed integrally with the intermediate pulley 442 is rotated. When the intermediate gear 444 is rotated, the third gear 451 engaged with the intermediate gear 444 is rotated, and when the third gear 451 is rotated, the second pulley 452 formed integrally with the third gear 451 is rotated. When the second pulley 452 is rotated, the first pulley 425 is rotated by the second belt 453. When the first pulley 425 is rotated, the outer ring of the second one-way clutch 422 connected to the first pulley 425 is rotated.

In the present embodiment, when the shaft 431 of the motor 43 is rotated in the clockwise direction, the inner ring of the second one-way clutch 422 is rotated together with the outer ring so that the second shaft 421 in which the inner ring is disposed is rotated. Accordingly, when the shaft 431 of the motor 43 is rotated in the clockwise direction, the second paper feeding roller 42 is rotated in the counterclockwise direction, thereby conveying the print medium from the second paper feeding tray 30.

In the present embodiment, the rotational force of the intermediate gear 444 is configured to be transmitted to the second one-way clutch 422 disposed in the second shaft 421 by using the belt structure including the first and second pulleys 425 and 452 and the second belt 453. However, the structure of the second power transmission member 45 is not limited by this. Although not illustrated, the power may be configured to be transmitted from the intermediate gear 444 to the second one-way clutch 422 by using at least one gear.

Also, in the present embodiment, as illustrated in FIGS. 2 and 3, the third gear 451 and the second pulley 452 may be disposed at one end of a third shaft 481, and a conveying roller 48 may be disposed in the third shaft 481. The third shaft 481 is rotatably supported by a pair of bushes 483 and 484 fixed to the main body frame (not illustrated). The conveying roller 48 is disposed to rotate in contact with a third idle roller 488 to convey the print medium fed from the second paper feeding tray 30 to a main paper path 12. Here, the main paper path 12 refers to a path of the print medium to guide the print medium to be supplied from the first and second paper feeding trays 20 and 30 to the image forming unit 80.

A third one-way clutch 482 may be disposed between the second pulley 452 and the third shaft 481. In detail, an outer ring of the third one-way clutch 482 is disposed to rotate together with the second pulley 452, and an inner ring thereof is fixed to the third shaft 481. Since when the second paper feeding roller 42 is rotated in the counterclockwise direction, the print medium of the second paper feeding tray 30 is conveyed, the third shaft 481 also is disposed to rotate in the counterclockwise direction. Alternatively, if the second paper feeding roller 42 is able to convey the print medium from the second paper feeding tray 30 to the main paper path 12, the conveying roller 48 may not be installed.

Hereinafter, operation of the paper feeding apparatus for an image forming apparatus according to a first embodiment of the present disclosure will be described in detail with reference to FIGS. 4A and 4B.

When desiring to supply the print medium from the first paper feeding tray 20, a controller 19 of the image forming apparatus 1 rotates the first pickup roller 21 so as to pick up the print medium loaded in the first paper feeding tray 20, and controls the motor 43 of the paper feeding apparatus 40 so the shaft 431 of the motor 43 rotates in the counterclockwise direction. As illustrated in FIG. 4A, when the shaft 431 of the motor 43 rotates in the counterclockwise direction, the drive pulley 441 is rotated in the counterclockwise direction, and the intermediate pulley 442 also is rotated in the counterclockwise direction by the first belt 443. When the intermediate pulley 442 is rotated in the counterclockwise direction, the intermediate gear 444 formed integrally with the intermediate pulley 442 also is rotated in the counterclockwise direction.

When the intermediate gear 444 is rotated in the counterclockwise direction, the second gear 445 and the third gear 451 engaged with the intermediate gear 444 are rotated in the clockwise direction. When the second gear 445 is rotated in the clockwise direction, the first gear 415 engaged with the second gear 445 is rotated in the counterclockwise direction. When the first gear 415 is rotated in the counterclockwise direction, the outer ring of the first one-way clutch 412 is rotated in the counterclockwise direction. Since the first one-way clutch 412 is disposed so that, if the outer ring of the first one-way clutch 412 is rotated in the counterclockwise direction, the inner ring thereof is rotated integrally with the outer ring, when the outer ring of the first one-way clutch 412 is rotated in the counterclockwise direction, the inner ring of the first one-way clutch 412 also is rotated integrally with the outer ring in the counterclockwise direction. When the inner ring of the first one-way clutch 412 is rotated in the counterclockwise direction, the first shaft 411 in which the inner ring is disposed is rotated in the counterclockwise direction. When the first shaft 411 is rotated in the counterclockwise direction, the first paper feeding roller 41 disposed coaxially on the first shaft 411 is rotated in the counterclockwise direction. When the first paper feeding roller 41 is rotated in the counterclockwise direction, the print medium which is picked up and conveyed to the first paper feeding roller 41 by the first pickup roller 21 is moved to the main paper path 12.

When the third gear 451 is rotated in the clockwise direction by the intermediate gear 444, the second pulley 452 formed integrally with the third gear 451 also is rotated in the clockwise direction. When the second pulley 452 is rotated in the clockwise direction, the first pulley 425 also is rotated in the clockwise direction by the second belt 453. When the first pulley 425 is rotated in the clockwise direction, the outer ring of the second one-way clutch 422 connected to the first pulley 425 also is rotated in the clockwise direction integrally with the first pulley 425. Since the second one-way clutch 422 is disposed so that, if the outer ring of the second one-way clutch 422 is rotated in the counterclockwise direction, the inner ring thereof is rotated together with the outer ring, when the outer ring thereof is rotated in the counterclockwise direction, the inner ring of the second one-way clutch 422 is on the stationary state without rotating. Accordingly, when the motor 43 rotates in the counterclockwise direction, the power is not transmitted by the second one-way clutch 422 so that the second paper feeding roller 42 disposed in the second shaft 421 is not rotated.

On the other hand, when desiring to supply the print medium from the second paper feeding tray 30, the controller 19 of the image forming apparatus 1 rotates the second pickup roller 31 so as to pick up the print medium loaded in the second paper feeding tray 30, and controls the motor 43 of the paper feeding apparatus 40 so the shaft 431 of the motor 43 rotates in the clockwise direction. As illustrated in FIG. 4B, when the shaft 431 of the motor 43 is rotated in the clockwise direction, the drive pulley 441 is rotated in the clockwise direction, and the intermediate pulley 442 also is rotated in the clockwise direction by the first belt 443. When the intermediate pulley 442 is rotated in the clockwise direction, the intermediate gear 444 formed integrally with the intermediate pulley 442 also is rotated in the clockwise direction.

When the intermediate gear 444 is rotated in the clockwise direction, the second gear 445 and the third gear 451 engaged with the intermediate gear 444 are rotated in the counterclockwise direction. When the third gear 451 is rotated in the counterclockwise direction, the second pulley 452 formed integrally with the third gear 451 also is rotated in the counterclockwise direction. When the second pulley 452 is rotated in the counterclockwise direction, the first pulley 425 also is rotated in the counterclockwise direction by the second belt 453. When the first pulley 425 is rotated in the counterclockwise direction, the outer ring of the second one-way clutch 422 connected to the first pulley 425 is rotated integrally with the first pulley 425 in the counterclockwise direction. Since the second one-way clutch 422 is disposed so that, if the outer ring of the second one-way clutch 422 is rotated in the counterclockwise direction, the inner ring thereof is rotated together with the outer ring, when the outer ring thereof is rotated in the counterclockwise direction, the inner ring of the second one-way clutch 422 also is rotated together with the outer ring in the counterclockwise direction. When the inner ring of the second one-way clutch 422 is rotated in the counterclockwise direction, the second shaft 421 in which the inner ring is disposed is rotated in the counterclockwise direction. When the second shaft 421 is rotated in the counterclockwise direction, the second paper feeding roller 42 disposed coaxially on the second shaft 421 is rotated in the counterclockwise direction. When the second paper feeding roller 42 is rotated in the counterclockwise direction, the print medium which is picked up and conveyed to the second paper feeding roller 42 by the second pickup roller 31 is moved to the main paper path 12.

When the second gear 445 is rotated in the counterclockwise direction by the intermediate gear 444, the first gear 415 engaged with the second gear 445 is rotated in the clockwise direction. When the first gear 415 is rotated in the clockwise direction, the outer ring of the first one-way clutch 412 also is rotated in the clockwise direction. Since the first one-way clutch 412 is disposed so that, only when the outer ring of the first one-way clutch 412 is rotated in the counterclockwise direction, the inner ring of the first one-way clutch 412 is rotated together with the outer ring, when the outer ring thereof is rotated in the clockwise direction, the inner ring of the first one-way clutch 412 is not rotated. Accordingly, when the motor 43 rotates in the clockwise direction, the power is not transmitted by the first one-way clutch 412 so that the first paper feeding roller 41 disposed in the first shaft 411 is not rotated.

Accordingly, with the paper feeding apparatus 40, according to an embodiment of the present disclosure, when the motor 43 rotates in the counterclockwise direction, the first paper feeding roller 41 is rotated and the second paper feeding roller 42 is not rotated so that the print medium of only the first paper feeding tray 20 is supplied to the image forming unit 80. On the contrary, when the motor 43 rotates in the clockwise direction, the second paper feeding roller 42 is rotated and the first paper feeding roller 41 is not rotated so that the print medium of only the second paper feeding tray 30 is supplied to the image forming unit 80. Accordingly, according to an embodiment of the present disclosure, it is possible to selectively supply a print medium from one of the two paper feeding trays 20 and 30 by controlling the rotation direction of the motor 43 of the paper feeding apparatus 40.

In the above description, the image forming apparatus 1 includes two paper feeding trays 20 and 30. However, the image forming apparatus 1 according to an embodiment of the present disclosure may include two or more paper feeding trays. For example, the image forming apparatus may include a number of paper feeding trays corresponding to a multiple of 2, such as four, six, eight, etc.

FIG. 5 is a cross-sectional view schematically illustrating an image forming apparatus including the two paper feeding apparatuses according to a first embodiment of the present disclosure. FIG. 6A is a partial cross-sectional view illustrating when a first paper feeding tray of the paper feeding apparatus of FIG. 5 supplies a print medium, and FIG. 6B is a partial cross-sectional view illustrating when a fourth paper feeding tray of the paper feeding apparatus of FIG. 5 supplies a print medium.

Figure 6B:
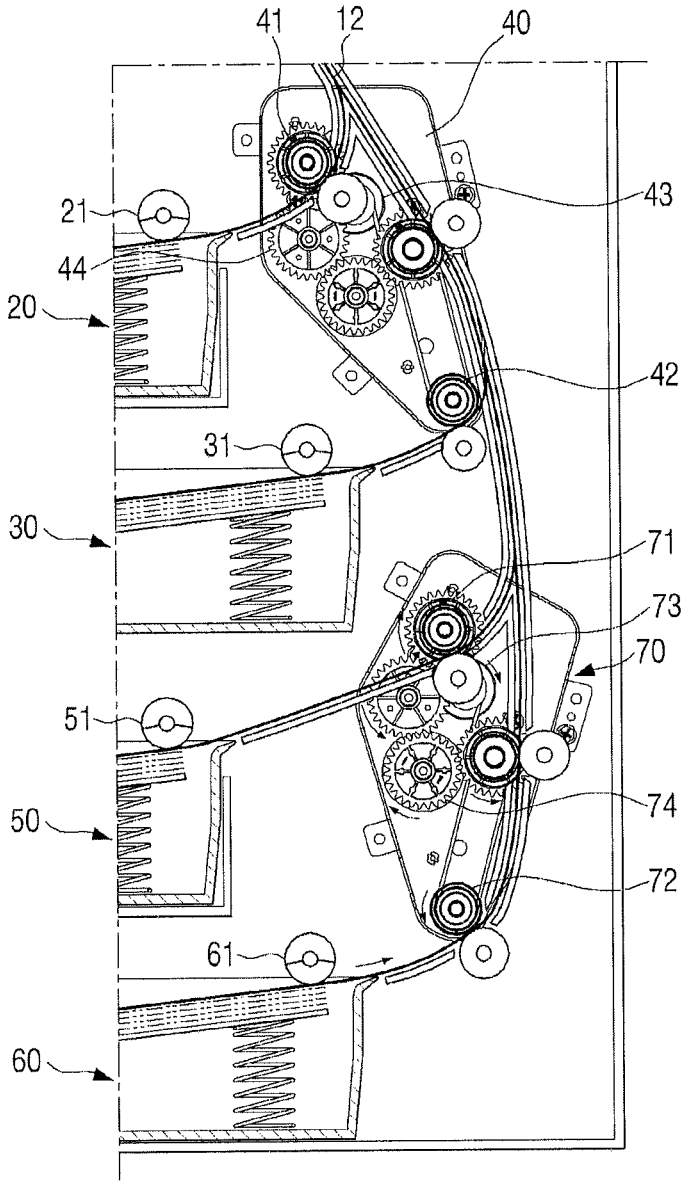
FIG. 6B is a partial cross-sectional view illustrating when a fourth paper feeding tray of the paper feeding apparatus of FIG. 5 supplies a print medium.
Figure 7:
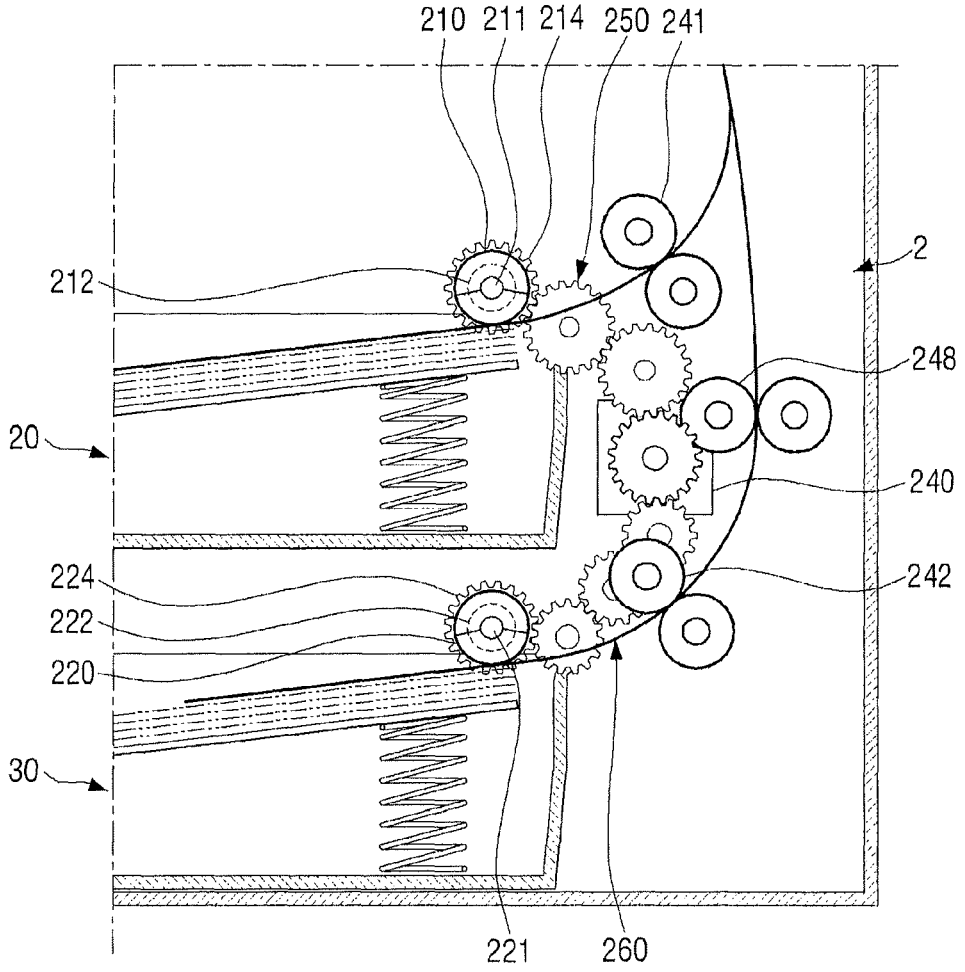
FIG. 7 is a partial cross-sectional view illustrating a paper feeding apparatus according to a second embodiment of the present disclosure.

Referring to FIGS. 5, 6A, and 6B, the image forming apparatus 1' according to an embodiment of the present disclosure is the same as the image forming apparatus 1 according to a first embodiment of the present disclosure as described above except that the image forming apparatus 1' includes four paper feeding trays 20, 30, 50, and 60 and two paper feeding apparatuses 40 and 70. Accordingly, detailed descriptions for the structure of first and second paper feeding apparatuses 40 and 70 will be omitted.

In the present embodiment, when the controller 19 of the image forming apparatus 1' wants to supply the print medium of first paper feeding tray 20, as illustrated in FIG. 6A, the controller 19 rotates a motor shaft 431 of a first motor 43 of a first paper feeding apparatus 40 in the counterclockwise direction. Thus, the first paper feeding roller 41 of the first paper feeding tray 20 is rotated in the counterclockwise direction, thereby supplying the print medium from the first paper feeding tray 20. At this time, the second paper feeding roller 42 of the first paper feeding apparatus 40 is not rotated so that the print medium of the second paper feeding tray 30 is not supplied. Also, since the electric power is not supplied to a second motor 73 of a second paper feeding apparatus 70, the print media of third and fourth paper feeding trays 50 and 60 are not supplied.

When desiring to supply the print medium from the second paper feeding tray 30, the controller 19 of the image forming apparatus 1' rotates the motor shaft 431 of the first motor 43 of the first paper feeding apparatus 40 in the clockwise direction. Thus, the second paper feeding roller 42 of the first paper feeding apparatus 40 is rotated in the counterclockwise direction so as to supply the print medium from the second paper feeding tray 30. At this time, since the first paper feeding roller 41 of the first paper feeding apparatus 40 is not rotated, the print medium of the first paper feeding tray 20 is not supplied. Also, since the electric power is not supplied to a second motor 73 of the second paper feeding apparatus 70, the print media of third and fourth paper feeding trays 50 and 60 also are not supplied.

In addition, when desiring to supply the print medium from the third paper feeding tray 50, the controller 19 of the image forming apparatus 1' rotates a motor shaft of the second motor 73 of the second paper feeding apparatus 70 in the counterclockwise direction. Thus, a third paper feeding roller 71 of the second paper feeding apparatus 70 is rotated in the counterclockwise direction so as to supply the print medium from the third paper feeding tray 50. At this time, since a fourth paper feeding roller 72 of the second paper feeding apparatus 70 is not rotated, the print medium of the fourth paper feeding tray 60 is not supplied. Also, since the electric power is not supplied to the first motor 43 of the first paper feeding apparatus 40, the print media of first and second paper feeding trays 20 and 30 also are not supplied.

When desiring to supply the print medium from the fourth paper feeding tray 60, the controller 19 of the image forming apparatus 1', as illustrated in FIG. 6B, rotates the motor shaft of the second motor 73 of the second paper feeding apparatus 70 in the clockwise direction. Thus, the fourth paper feeding roller 72 of the second paper feeding apparatus 70 is rotated in the counterclockwise direction so as to supply the print medium from the fourth paper feeding tray 60. At this time, since the third paper feeding roller 71 of the second paper feeding apparatus 70 is not rotated, the print medium of the third paper feeding tray 50 is not supplied. Also, since the electric power is not supplied to the first motor 43 of the first paper feeding apparatus 40, the print media of first and second paper feeding trays 20 and 30 also are not supplied.

Hereinafter, a paper feeding apparatus for an image forming apparatus according to a second embodiment of the present disclosure will be described with reference to FIG. 7. FIG. 7 is a partial cross-sectional view illustrating a paper feeding apparatus according to a second embodiment of the present disclosure.

In a paper feeding apparatus 2 according to a second embodiment of the present disclosure, the first and second paper feeding rollers are applied to first and second pickup rollers 210 and 220. As illustrated in FIG. 7, the paper feeding apparatus 2 according to an embodiment of the present disclosure may include, for example, first and second paper feeding trays 20 and 30, a drive source 240, first and second power transmission members 250 and 260, and first and second pickup rollers 210 and 220.

The drive source 240 may use the same as the drive source 43 of the paper feeding apparatus 40 according to the first embodiment of the present disclosure as described above. Therefore, a detailed description thereof is omitted. In the present embodiment, a motor capable of bi-directional rotation may be used as the drive source 240.

The first power transmission member 250 transmits the power of the motor 240 to the first pickup roller 210, and is configured of two gears in the present embodiment. The second power transmission member 260 transmits the power of the motor 240 to the second pickup roller 220, and is configured of three gears in the present embodiment. In the present embodiment, the first and second power transmission members 250 and 260 are configured of a plurality of gears; however, this does not limit the configuration of the first and second power transmission members 250 and 260. The first and second power transmission members 250 and 260 may be configured in a variety of ways as long as the rotation direction of the rotational force transmitted by the first power transmission member 250 is opposite to the rotation direction of the rotational force transmitted by the second power transmission member 260. For example, the first and second power transmission members 250 and 260 may be configured by mixing a belt transmission system and a gear transmission system.

The first pickup roller 210 picks up the print media loaded in the first paper feeding tray 20 one-by-one. The first one-way clutch 212 is disposed in one side of the first pickup roller 210. In detail, the inner ring of the first one-way clutch 212 is fixed to the shaft 211 of the first pickup roller 210, and the outer ring of the first one-way clutch 212 is fixed to a first pickup gear 214 disposed coaxially on the shaft of the first pickup roller 210. The first one-way clutch 212 is disposed so that when the outer ring of the first one-way clutch 212 is rotated in the counterclockwise direction, the inner ring of the first one-way clutch 212 is rotated together with the outer ring, and when the outer ring is rotated in the clockwise direction, the inner ring is on the stationary state. Accordingly, when the motor 240 rotates in the clockwise direction, the first pickup gear 214 receiving the power through the first power transmission member 250 is rotated in the counterclockwise direction so that the outer ring of the first one-way clutch 212 connected to the first pickup gear 214 is rotated in the counterclockwise direction. Accordingly, the inner ring of the first one-way clutch 212 also is rotated in the counterclockwise direction so that the first pickup roller 210 disposed integrally with the inner ring also is rotated in the counterclockwise direction, thereby picking up the print medium loaded in the first paper feeding tray 20.

The second pickup roller 220 picks up the print media loaded in the second paper feeding tray 30 one-by-one. The second one-way clutch 222 is disposed in one side of the second pickup roller 220. In detail, the inner ring of the second one-way clutch 222 is fixed to the shaft 221 of the second pickup roller 220, and the outer ring of the second one-way clutch 222 is fixed to a second pickup gear 224 disposed coaxially on the shaft 221 of the second pickup roller 220. The second one-way clutch 222 is disposed so that when the outer ring of the second one-way clutch 222 is rotated in the counterclockwise direction, the inner ring of the second one-way clutch 222 is rotated together with the outer ring, and when the outer ring is rotated in the clockwise direction, the inner ring is on the stationary state. Accordingly, when the motor 240 rotates in the counterclockwise direction, the second pickup gear 224 receiving the power through the second power transmission member 260 is rotated in the counterclockwise direction so that the outer ring of the second one-way clutch 222 connected to the second pickup gear 224 is rotated in the counterclockwise direction. Accordingly, the inner ring of the second one-way clutch 222 also is rotated in the counterclockwise direction so that the second pickup roller 210 disposed integrally with the inner ring also is rotated in the counterclockwise direction, thereby picking up the print medium loaded in the second paper feeding tray 30.

The print medium picked up by the first and second pickup rollers 210 and 220 is conveyed to the main paper path by the feed rollers 241 and 242, and then is supplied to the image forming unit.

Hereinafter, a paper feeding apparatus for an image forming apparatus according to a third embodiment of the present disclosure will be described with reference to FIGS. 8, 9A, and 9B.

Figure 8:
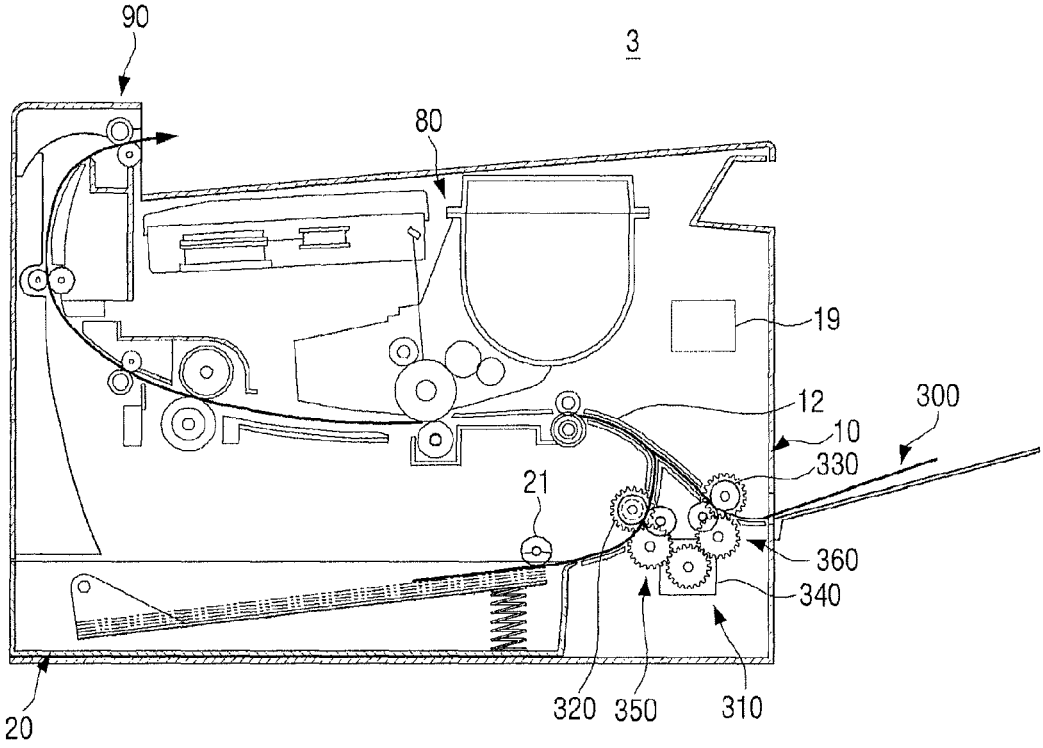
FIG. 8 is a cross-sectional view schematically illustrating an image forming apparatus including a paper feeding apparatus according to a third embodiment of the present disclosure.

FIG. 8 is a cross-sectional view schematically illustrating an image forming apparatus including a paper feeding apparatus according to a third embodiment of the present disclosure. FIG. 9A is a partial cross-sectional view illustrating when a first paper feeding tray of the paper feeding apparatus of FIG. 8 supplies a print medium, and FIG. 9B is a partial cross-sectional view illustrating when a second paper feeding tray of the paper feeding apparatus of FIG. 9 supplies a print medium.

Referring to FIG. 8, an image forming apparatus 3 according to an embodiment of the present disclosure may include, for example, a main body 10, two paper feeding trays 20 and 300, an image forming unit 80, a paper discharging unit 90, and a paper feeding apparatus 310.

The main body 10, the image forming unit 80, and the paper discharging unit 90 are the same as those of the image forming apparatus 1 according to the first embodiment of the present disclosure as described above and therefore detailed descriptions thereof are omitted.

The two paper feeding trays 20 and 300 includes a first paper feeding tray 20 disposed inside the main body 10 and a second paper feeding tray 300 disposed outside the main body 10. The second paper feeding tray 300 is configured of a manual paper feeding unit that can supply a variety of print media.

The two paper feeding trays 20 and 300 are arranged facing each other. The first paper feeding tray 20 and the second paper feeding tray 300 are disposed to feed the print medium in the direction opposite to each other. In detail, as illustrated in FIG. 8, the first paper feeding tray 20 is arranged to feed the print medium in the right direction, and the second paper feeding tray 300 is arranged to feed the print medium in the left direction. Accordingly, the second paper feeding tray 300 according to the present embodiment that is disposed facing the first paper feeding tray 20 in one side of the first paper feeding tray 20 is different from the first and second embodiments as described above having the structure in which the plurality of paper feeding trays 20 and 30 are arranged to be stacked in the vertical direction. Also, the paper feeding apparatus according to the present embodiment in which the first and second paper feeding trays 20 and 300 are disposed to feed the print medium in the direction opposite to each other is different from the paper feeding apparatuses according to the first and second embodiments as described above in which the plurality of paper feeding trays 20 and 30 is disposed to feed the print medium in the same direction.

The paper feeding apparatus 310 is formed to supply selectively the print medium loaded in one of the two paper feeding trays 20 and 300 to the image forming unit 80.

Figure 9A:
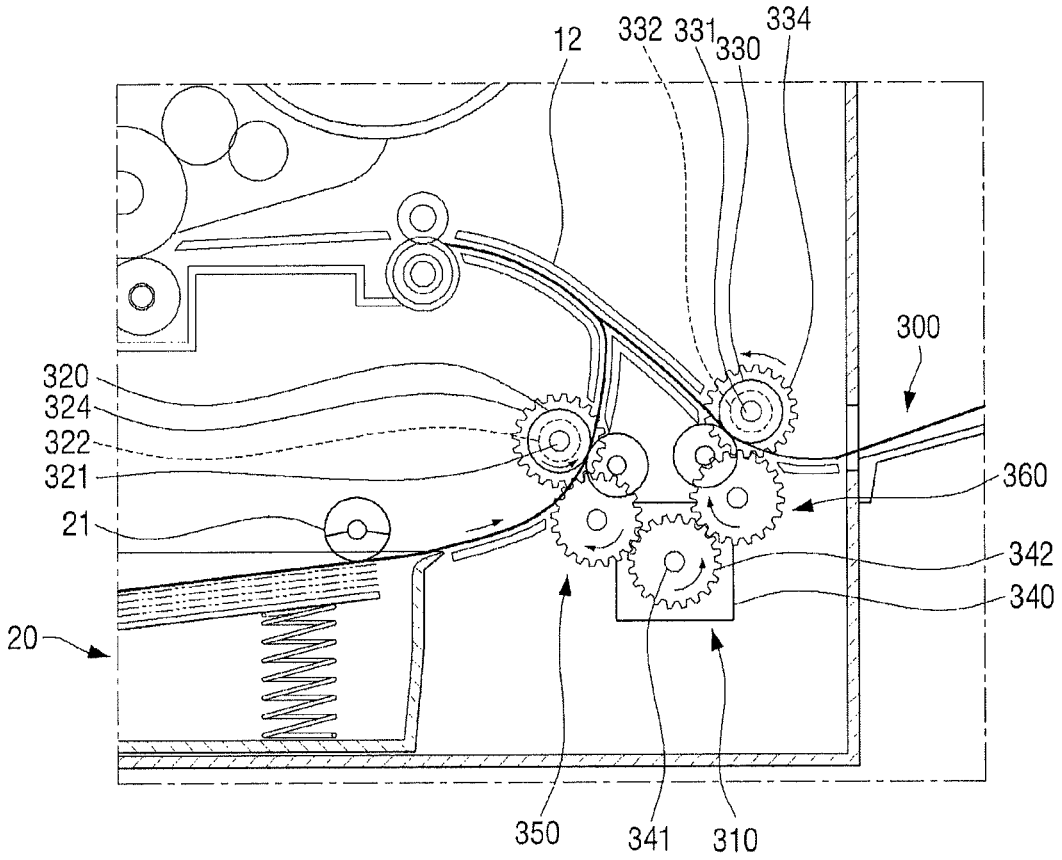
FIG. 9A is a partial cross-sectional view illustrating when a first paper feeding tray of the paper feeding apparatus of FIG. 8 supplies a print medium.
Figure 9B:
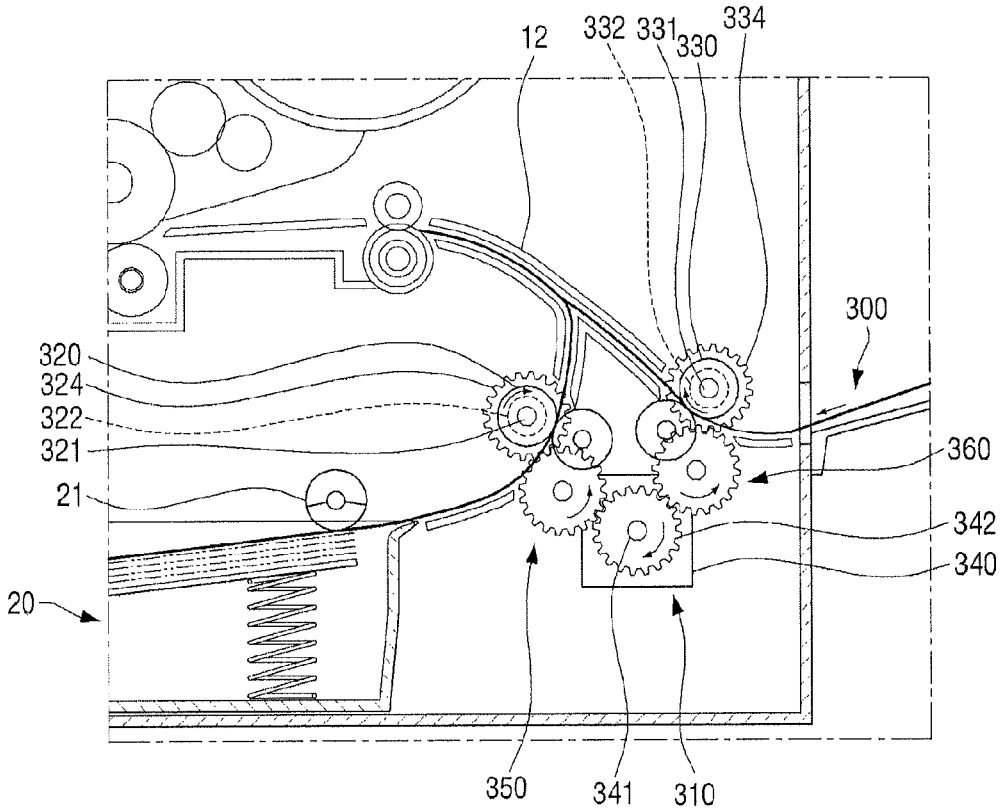
FIG. 9B is a partial cross-sectional view illustrating when a second paper feeding tray of the paper feeding apparatus of FIG. 8 supplies a print medium.

Referring to FIGS. 8, 9A, and 9B, the paper feeding apparatus 310 may include a first paper feeding roller 320, a second paper feeding roller 330, a drive source 340, a first power transmission member 350, and a second power transmission member 360.

The first paper feeding roller 320 is disposed in the first paper feeding tray 20, and moves the print medium loaded in the first paper feeding tray 20 toward the image forming unit 80. The first paper feeding roller 320 is a roller that is used to move the print medium loaded in the first paper feeding tray 20 toward the image forming unit 80. In detail, the first paper feeding roller 320 is a feed roller to move the print medium picked up by the pickup roller 21 from the first paper feeding tray 20 toward the image forming unit 80.

The second paper feeding roller 330 is disposed in the second paper feeding tray 300, and moves the print medium loaded in the second paper feeding tray 300 toward the image forming unit 80. The second paper feeding roller 42 is a feed roller to move the print medium loaded on the second paper feeding tray 30 by a user toward the image forming unit 80.

The first paper feeding roller 320 is disposed coaxially on a first shaft 321 that is rotatably supported by two bushes (not illustrated). A first one-way clutch 322 is disposed at one end of the first shaft 321. In detail, the inner ring of the first one-way clutch 322 is fixed to the first shaft 321 of the first paper feeding roller 320, and the outer ring of the first one-way clutch 322 is fixed to a first paper feeding gear 324 that is disposed coaxially with the first shaft 321 of the first paper feeding roller 320. The first one-way clutch 322 is disposed so that when the outer ring of the first one-way clutch 322 is rotated in the counterclockwise direction, the inner ring of the first one-way clutch 322 is rotated together with the outer ring, and when the outer ring is rotated in the clockwise direction, the inner ring is on the stationary state.

The second paper feeding roller 330 is disposed coaxially on a second shaft 331 that is rotatably supported by two bushes (not illustrated). A second one-way clutch 332 is disposed at one end of the second shaft 331. In detail, the inner ring of the second one-way clutch 332 is fixed to the second shaft 331 of the second paper feeding roller 330, and the outer ring of the second one-way clutch 332 is fixed to a second paper feeding gear 334 that is disposed coaxially with the second shaft 331 of the second paper feeding roller 330. The second one-way clutch 332 is disposed so that when the outer ring of the second one-way clutch 322 is rotated in the clockwise direction, the inner ring of the second one-way clutch 332 is rotated together with the outer ring, and when the outer ring is rotated in the counterclockwise direction, the inner ring is on the stationary state. In other words, the second one-way clutch 422 is disposed to deliver the rotation of the direction opposite to the first one-way clutch 322 to the second paper feeding roller 330. For reference, the structure of the first and second paper feeding rollers 320 and 330, the first and second shafts 321 and 331, and the first and second one-way clutches 322 and 332 may be formed to be the same as or similar to the structure of the first and second paper feeding rollers 41 and 42, the first and second shafts 411 and 421, and the first and second one-way clutches 412 and 422 of the paper feeding apparatus 40 according to the first embodiment of the present disclosure as described above as illustrated in FIG. 3.

The drive source 340 may be the same as or similar to the drive source 43 of the paper feeding apparatus 40 according to the first embodiment of the present disclosure as described above. Therefore, a detailed description thereof is omitted. In the present embodiment, a motor capable of bi-directional rotation may be used as the drive source 340.

The first power transmission member 350 transmits the power of the motor 340 to the first paper feeding roller 320. In this embodiment, the first power transmission member 350 is configured of a single gear. The second power transmission member 360 transmits the power of the motor 340 to the second paper feeding roller 330. In this embodiment, the second power transmission member 360 is configured of a single gear like the first power transmission member 350. In the present embodiment, the first and second power transmission members 350 and 360 are configured of the gear; however, this does not limit the configuration of the first and second power transmission members 350 and 360. The first and second power transmission members 350 and 360 may be configured in a variety of ways as long as the rotation direction of the rotational force transmitted by the first power transmission member 350 is the same as the rotation direction of the rotational force transmitted by the second power transmission member 360. For example, the first and second power transmission members 350 and 360 may be configured by a belt structure using a belt and pulleys.

Hereinafter, operation of the paper feeding apparatus for an image forming apparatus according to a third embodiment of the present disclosure will be described in detail with reference to FIGS. 9A and 9B.

When desiring to supply the print medium from the first paper feeding tray 20, the controller 19 of the image forming apparatus 3 rotates the first pickup roller 21 so as to pick up the print medium loaded in the first paper feeding tray 20, and controls the motor 340 of the paper feeding apparatus 310 so the motor shaft 341 rotates in the counterclockwise direction. As illustrated in FIG. 9A, when the motor shaft 341 rotates in the counterclockwise direction, the drive gear 342 is rotated in the counterclockwise direction. When the drive gear 342 is rotated in the counterclockwise direction, the first transmission gear configuring the first power transmission member 350 is rotated in the clockwise direction. When the first transmission gear 350 is rotated in the clockwise direction, the first paper feeding gear 324 engaged with the first transmission gear 350 is rotated in the counterclockwise direction. When the first paper feeding gear 324 is rotated in the counterclockwise direction, the outer ring of the first one-way clutch 322 connected to the first paper feeding gear 324 is rotated in the counterclockwise direction so that the inner ring of the first one-way clutch 322 also is rotated in the counterclockwise direction. Accordingly, the first shaft 321 disposed integrally with the inner ring of the first one-way clutch 322 is rotated in the counterclockwise direction so that the first paper feeding roller 320 disposed coaxially on the first shaft 321 is rotated in the counterclockwise direction so as to convey the print medium picked up by the pickup roller 21 to the main paper path 12.

Also, when desiring to supply the print medium from the second paper feeding tray 300, the controller 19 of the image forming apparatus 3 controls the motor 340 of the paper feeding apparatus 310 so the motor shaft 341 rotates in the clockwise direction. As illustrated in FIG. 9B, when the motor shaft 341 rotates in the clockwise direction, the drive gear 342 is rotated in the clockwise direction, and when the drive gear 342 is rotated in the clockwise direction, the second gear configuring the second power transmission member 360 is rotated in the counterclockwise direction. When the second transmission gear 360 is rotated in the counterclockwise direction, the second paper feeding gear 334 engaged with the second transmission gear 360 is rotated in the clockwise direction. When the second paper feeding gear 334 is rotated in the clockwise direction, the outer ring of the second one-way clutch 332 connected to the second paper feeding gear 334 is rotated in the clockwise direction so that the inner ring of the second one-way clutch 332 also is rotated in the clockwise direction. Accordingly, the second shaft 331 disposed integrally with the inner ring of the second one-way clutch 332 is rotated in the clockwise direction so that the second paper feeding roller 330 disposed coaxially on the second shaft 331 is rotated in the clockwise direction so as to convey the print medium loaded in the second paper feeding tray 300 to the main paper path 12.

Figure 10:
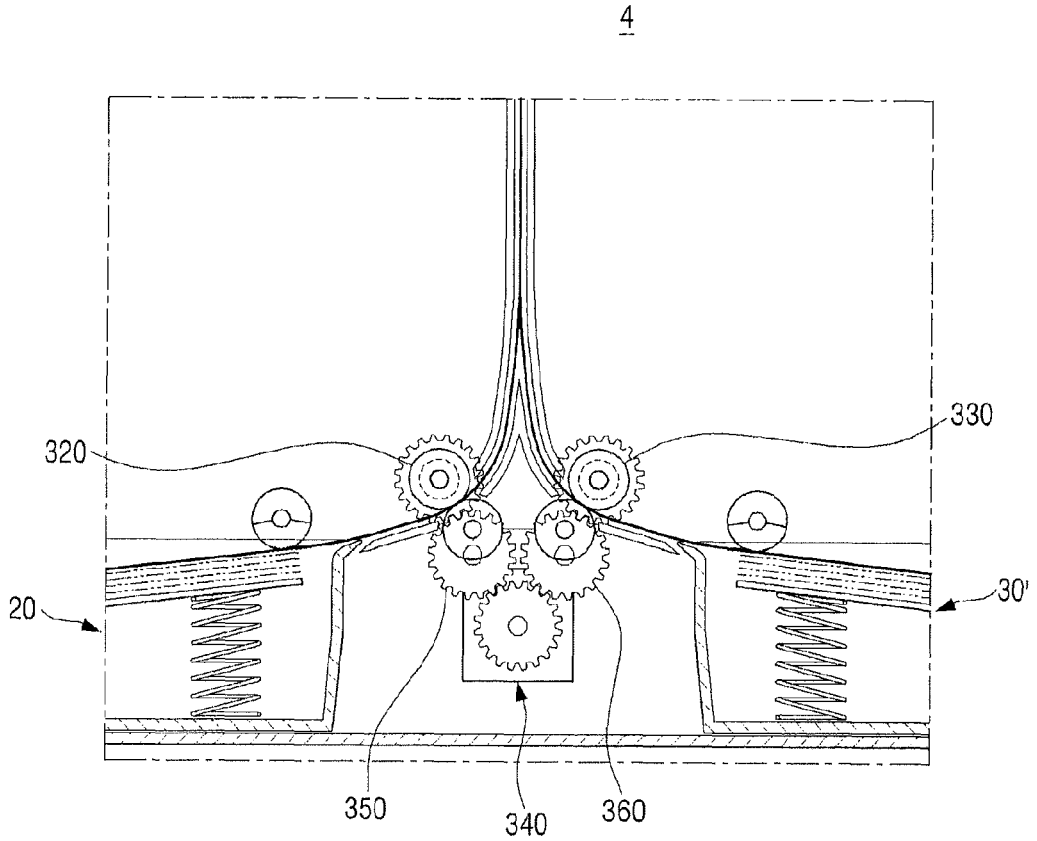
FIG. 10 is a partial cross-sectional view illustrating a paper feeding apparatus according to a fourth embodiment of the present disclosure.

Hereinafter, a paper feeding apparatus for an image forming apparatus according to a fourth embodiment of the present disclosure will be described with reference to FIG. 10. FIG. 10 is a partial cross-sectional view illustrating a paper feeding apparatus according to a fourth embodiment of the present disclosure.

FIG. 10 illustrates paper feeding apparatus 4, according to a fourth embodiment of the present disclosure. Here, only a shape of a second paper feeding tray 30', is different from the second paper feeding tray 300 of the paper feeding apparatus 310 of the third embodiment of the present disclosure illustrated in FIG. 9, while the other parts are the same. In detail, the paper feeding apparatus 4 according to the fourth embodiment of the present disclosure having the second paper feeding tray 30' configured as a paper cassette form is different from the paper feeding apparatus 310 according to the third embodiment of the present disclosure having the second paper feeding tray 300 configured as a manual paper feeding unit form. In addition, the structure and operation of the drive source 340, the first and second paper feeding rollers 320 and 330, and the first and second power transmission members 350 and 360 of the paper feeding apparatus 4 according to the fourth embodiment of the present disclosure are the same as those of the paper feeding apparatus 310 according to the third embodiment of the present disclosure as described above. Therefore, detailed descriptions thereof are omitted.

Figure 11:
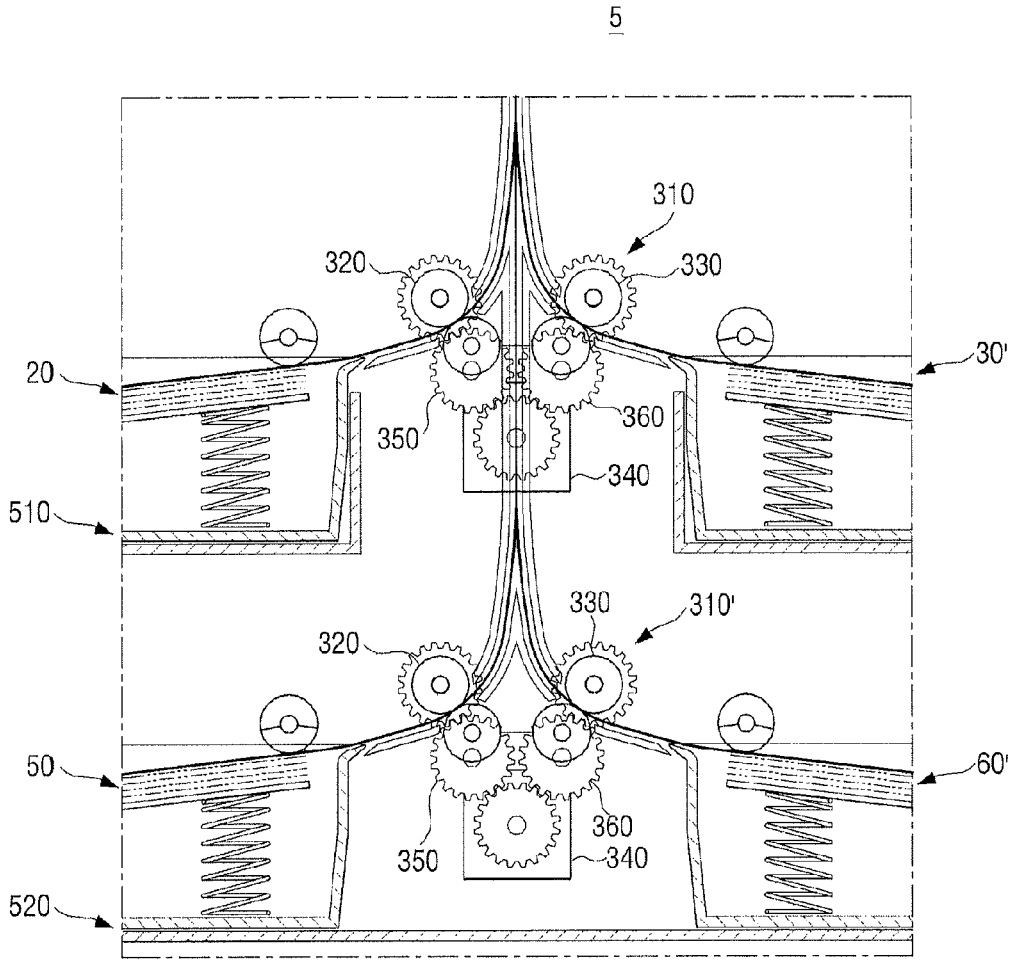
FIG. 11 is a partial cross-sectional view illustrating a paper feeding apparatus according to a fifth embodiment of the present disclosure.

Hereinafter, a paper feeding apparatus for an image forming apparatus according to a fifth embodiment of the present disclosure will be described with reference to FIG. 11. FIG. 11 is a partial cross-sectional view illustrating a paper feeding apparatus according to a fifth embodiment of the present disclosure.

Referring to FIG. 11, the paper feeding apparatus 5 according to a fifth embodiment of the present disclosure is different in the number of paper feeding trays from the paper feeding apparatus 4 according to the fourth embodiment of the present disclosure as illustrated in FIG. 10. However, other aspects of the paper feeding apparatus 5 according to the fifth embodiment of the present disclosure are the same as the paper feeding apparatus 4 according to the fourth embodiment of the present disclosure. In detail, in the paper feeding apparatus 5 according to the present embodiment, another pair of paper feeding trays 520 including third and fourth paper feeding trays 50 and 60' is disposed below the pair of paper feeding trays 510 including the first and second paper feeding trays 20 and 30' of the paper feeding apparatus 4 according to the fourth embodiment as illustrated in FIG. 10. Also, two paper feeding units 310 and 310' are disposed to selectively supply the print medium from the two pair of paper feeding trays 20 and 30'; 50 and 60' facing each other. In detail, the first paper feeding unit 310 is disposed to selectively supply the print medium from the first and second paper feeding trays 20 and 30', and the second paper feeding unit 310' is disposed to selectively supply the print medium from the third and fourth paper feeding trays 50 and 60'.

Each of the first and second paper feeding units 310 and 310' includes a drive source 340, first and second paper feeding rollers 320 and 330, and first and second power transmission members 350 and 360. The first paper feeding unit 310 is used to supply the print medium of the first and second paper feeding trays 20 and 30', and the second paper feeding unit 310' is used to supply the print medium of the third and fourth paper feeding trays 50 and 60'. In addition, the structure and operation of the first and second paper feeding units 310 and 310' are the same as the paper feeding apparatus 310 according to the third embodiment of the present disclosure as described above. Therefore, detailed descriptions thereof are omitted.

The paper feeding apparatus 4 for an image forming apparatus according to the fourth embodiment of the present disclosure as illustrated in FIG. 10 includes a pair of paper feeding trays 20 and 30' disposed to face each other, and the paper feeding apparatus 5 for an image forming apparatus according to the fifth embodiment of the present disclosure as illustrated in FIG. 11 includes two pair of paper feeding trays 20 and 30'; 50 and 60' disposed to face each other. However, the number of paper feeding trays of the image forming apparatus to which the present disclosure can be applied is not limited by this. The present disclosure may be applied to an image forming apparatus in which paired paper feeding trays including two paper feeding trays arranged to face each other are disposed in three or more stages, namely six or more and multiples of two paper feeding trays are disposed.

Figure 12:
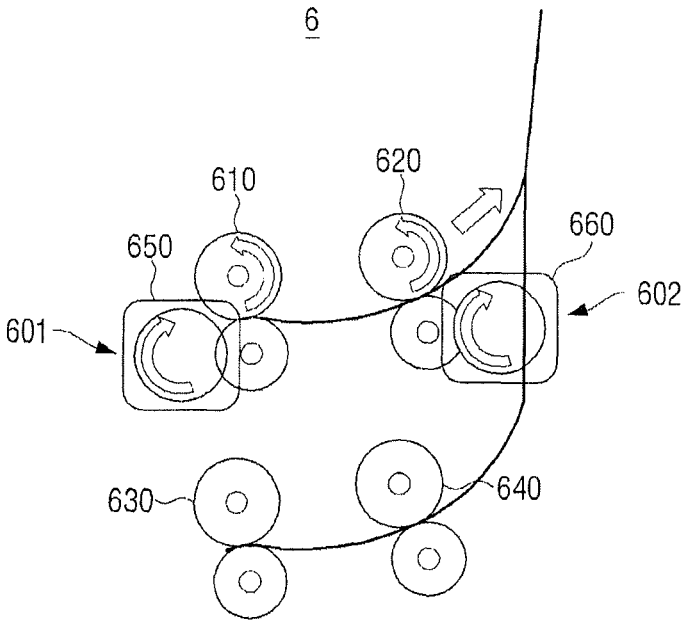
FIG. 12 is a conceptual view illustrating a paper feeding apparatus according to a sixth embodiment of the present disclosure.

Hereinafter, a paper feeding apparatus for an image forming apparatus according to a sixth embodiment of the present disclosure will be described with reference to FIG. 12. FIG. 12 is a conceptual view illustrating a paper feeding apparatus according to a sixth embodiment of the present disclosure. In FIG. 12, a first power transmission structure for transmitting power from a first motor 650 to a first paper feeding roller 610 of a first paper feeding tray (not illustrated) and a third paper feeding roller 630 of a second paper feeding tray (not illustrated), and a second power transmission structure for transmitting power from a second motor 660 to a second paper feeding roller 620 of the first paper feeding tray (not illustrated) and a fourth paper feeding roller 640 of the second paper feeding tray (not illustrated) are not illustrated. The first and second power transmission structures may be configured to be the same as or similar to the power transmission structures according to embodiments as described above.

Referring to FIG. 12, in the paper feeding apparatus 6 according to a sixth embodiment of the present disclosure, the present disclosure is applied to both the pickup roller and the feed roller unlike the embodiments as described above. In the above-described embodiments, the present disclosure is applied to only one of the pickup roller and the feed roller. However, in the present embodiment, the present disclosure is applied to both the pickup roller and the feed roller. In detail, the first paper feeding unit 601 is configured to selectively drive a pickup roller that is the first paper feeding roller 610 of the first paper feeding tray or a pickup roller that is the third paper feeding roller 630 of the second paper feeding tray depending on the rotation direction of the first motor 650, and the second paper feeding unit 602 is configured to selectively drive a feed roller that is the second paper feeding roller 620 of the first paper feeding tray or a feed roller that is the fourth paper feeding roller 640 of the second paper feeding tray depending on the rotation direction of the second motor 660. The structure and operation of the first and second paper feeding units 601 and 602 are the same as or similar to the paper feeding apparatus 40 according to the embodiments of the present disclosure as described above. Therefore, detailed descriptions thereof are omitted.

Figure 13:
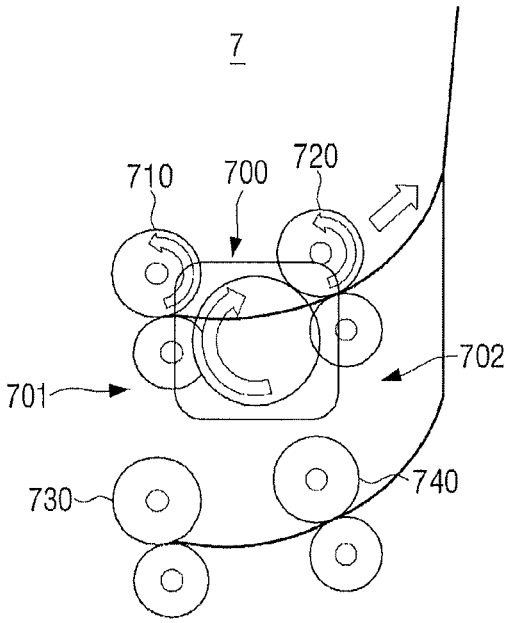
FIG. 13 is a conceptual view illustrating a paper feeding apparatus according to a seventh embodiment of the present disclosure.

Hereinafter, a paper feeding apparatus for an image forming apparatus according to a seventh embodiment of the present disclosure will be described with reference to FIG. 13. FIG. 13 is a conceptual view illustrating a paper feeding apparatus according to a seventh embodiment of the present disclosure. In FIG. 13, a first power transmission structure for transmitting power from a motor 700 to a first paper feeding roller 710 and a second paper feeding roller 720 of a first paper feeding tray (not illustrated) and a second power transmission structure for transmitting power from the motor 700 to a third paper feeding roller 730 and a fourth paper feeding roller 740 of a second paper feeding tray (not illustrated) are not illustrated. The first and second power transmission structures may be configured to be the same as or similar to the power transmission structures according to embodiments as described above.

Referring to FIG. 13, in the paper feeding apparatus 7 according to a seventh embodiment of the present disclosure, the present disclosure is applied to both the pickup roller and the feed roller as in the sixth embodiment as described above. The paper feeding apparatus 6 according to the sixth embodiment of the present disclosure as described above is configured to drive separately the two paper feeding units 601 and 602 by the two motors 650 and 660. However, the paper feeding apparatus 7 according to the present embodiment is different in that it is configured to drive two paper feeding units 701 and 702 using one motor 700. In detail, when the motor 700 rotates in one direction, the first paper feeding roller 710 (for example, a pickup roller) and the second paper feeding roller 720 (for example, a feed roller) of the first paper feeding tray (not illustrated) are rotated at the same time to supply the print medium. When the motor 700 rotates in the opposite direction, the third paper feeding roller 730 (for example, a pickup roller) and the fourth paper feeding roller 740 (for example, a feed roller) of the second paper feeding tray (not illustrated) are rotated at the same time to supply the print medium.

For example, as illustrated in FIG. 13, when the motor 700 rotates in the clockwise direction, the first paper feeding roller 710 and the second paper feeding roller 720 of the first paper feeding tray (not illustrated) are rotated in the counterclockwise direction to supply the print medium from the first paper feeding tray. At this time, since a clockwise rotational force is transmitted to an one-way clutch (not illustrated) disposed coaxially in each of the third paper feeding roller 730 and the fourth paper feeding roller 740 of the second paper feeding tray, the third paper feeding roller 730 and the fourth paper feeding roller 740 are not rotated. On the contrary, when the motor 700 rotates in the counterclockwise direction, the third paper feeding roller 730 and the fourth paper feeding roller 740 of the second paper feeding tray (not illustrated) are rotated in the counterclockwise direction to supply the print medium from the second paper feeding tray. At this time, since a clockwise rotational force is transmitted to an one-way clutch (not illustrated) disposed coaxially in each of the first paper feeding roller 710 and the second paper feeding roller 720 of the first paper feeding tray, the first paper feeding roller 710 and the second paper feeding roller 720 are not rotated.

When using the paper feeding apparatus for the image forming apparatus according to an embodiment of the present disclosure, the number of paper feeding rollers driven by a motor is reduced so that the capacity of the motor may be decreased. In order to verify this, at least one inventor of the present disclosure performed tests for comparing a torque applied to the motor when driving one paper feeding roller and a torque applied to the motor when driving two paper feeding rollers.

Figure 14A:
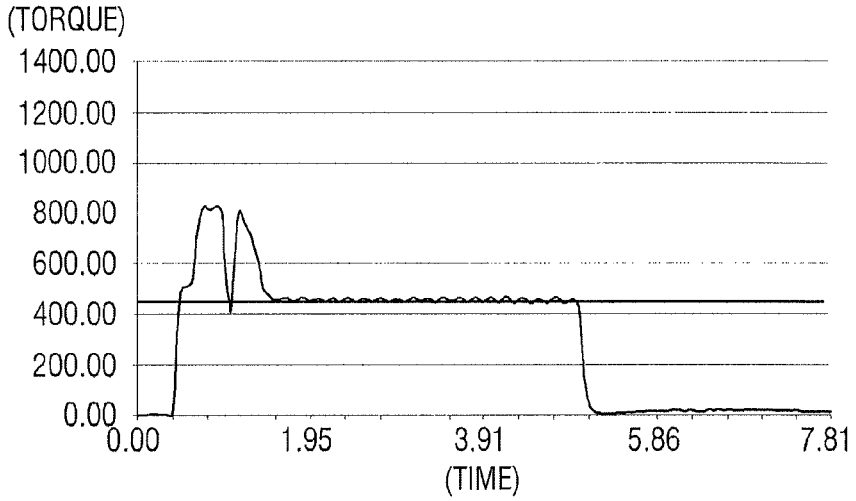
FIG. 14A is a graph illustrating a torque being applied to a motor which drives one feed roller.
Figure 14B:
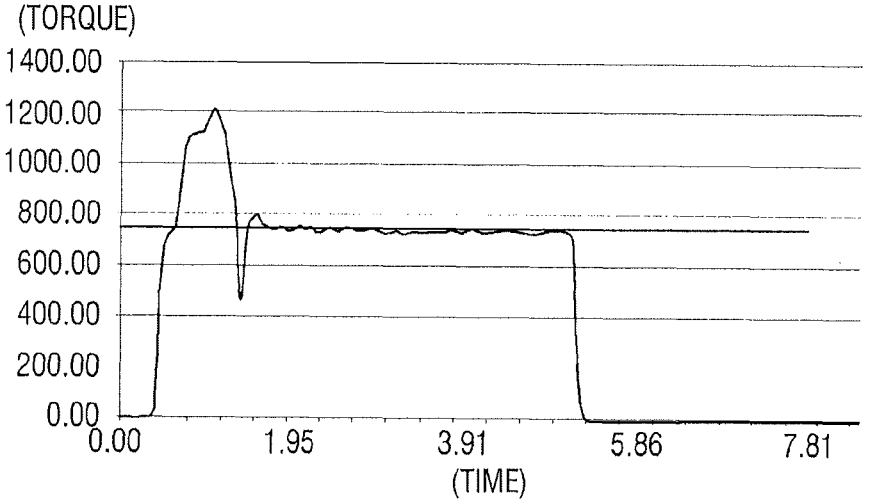
FIG. 14B is a graph illustrating a torque being applied to a motor which drives two feed rollers.

FIG. 14A is a graph illustrating a torque being applied to a motor when driving one paper feeding roller and FIG. 14B is a graph illustrating a torque being applied to a motor when driving two paper feeding rollers.

Referring to FIGS. 14A and 14B, it can be seen that when driving one paper feeding roller, an idle torque applied to the motor is 420 gfcm, and when driving two paper feeding rollers, the idle torque applied to the motor is 780 gfcm. These results are measured by a dynamic torque meter. It can be seen from the results that the load applied to the motor when driving one paper feeding roller is decreased to 53.8% of the load applied to the motor when driving two paper feeding rollers. Accordingly, by configuring the paper feeding apparatus for an image forming apparatus according to embodiments of the present disclosure, since the motor drives only one paper feeding roller, the paper feeding apparatus according to an embodiment of the present disclosure can use a motor of smaller capacity than the conventional paper feeding apparatus for driving two paper feeding rollers.

With the paper feeding apparatus according to embodiments of the present disclosure, since the capacity of the motor is minimized, power consumption may be reduced. Also, since the size of the motor is reduced, the size of the drive unit may be decreased. According to the calculation of at least one inventor of the present disclosure, the paper feeding apparatus according to embodiments of the present disclosure is about 60% in material cost of the motor, needs about 55% in motor space, and is set about 75% in motor current setting value compared to the conventional paper feeding apparatus for rotating the first and second paper feeding rollers at the same time using one motor.

Also, with the paper feeding apparatus according to embodiments of the present disclosure, since the minimal number of parts is operated when driving the paper feeding roller, noise may be reduced. According to the measurement of at least one inventor of the present disclosure, noise generated when driving one paper feeding roller is 36.14 dB, and noise generated when driving two paper feeding rollers is 37.65 dB. Therefore, when applying the present disclosure, there is a noise reduction effect of at least 1.55 dB.

In addition, since the paper feeding apparatus according to embodiments of the present disclosure does not use power control apparatuses, such as electronic clutches, etc., unlike the conventional paper feeding apparatus, the possibility of defective parts may be reduced, and the material cost may be decreased.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the inventive concepts.

What is claimed is:

1. A paper feeding apparatus for an image forming apparatus, the paper feeding apparatus comprising:

a first paper feeding roller configured to convey a print medium loaded in a first paper feeding tray;

a first one-way rotation transmission member disposed coaxially at the first paper feeding roller and configured to transmit a first one-way rotational force to the first paper feeding roller;

a second paper feeding roller configured to convey a print medium loaded in a second paper feeding tray disposed apart from the first paper feeding tray;

a second one-way rotation transmission member disposed coaxially at the second paper feeding roller and configured to transmit a second one-way rotational force to the second paper feeding roller;

a drive source configured to generate a rotational force to rotate the first and second paper feeding rollers;

a first power transmission member disposed between the first one-way rotation transmission member and the drive source, the first power transmission member configured to transmit power of the drive source to the first one-way rotation transmission member;

a second power transmission member disposed between the second one-way rotation transmission member and the drive source, the second power transmission member configured to transmit the power of the drive source to the second one-way rotation transmission member; and a conveying roller driven by the second power transmission member, wherein when the drive source rotates in a first direction, the first paper feeding roller conveys the print medium from the first paper feeding tray with the first one-way rotation transmission member, and when the drive source rotates in a direction opposite to the first direction, the second paper feeding roller conveys the print medium from the second paper feeding tray with the second one-way rotation transmission member.

2. The paper feeding apparatus of claim 1, wherein the first paper feeding tray is disposed parallel to the second paper feeding tray and above the second paper feeding tray.

3. The paper feeding apparatus of claim 2, wherein a rotational direction of a rotational force that the first power transmission member transmits to the first one-way rotation transmission member is opposite a rotational direction of a rotational force that the second power transmission member transmits to the second one-way rotation transmission member.

4. The paper feeding apparatus of claim 2, wherein the conveying roller is disposed to be rotated in a same direction as the second paper feeding roller, the conveying roller configured to convey the print medium being fed by the second paper feeding roller.

5. The paper feeding apparatus of claim 1, wherein the second paper feeding tray is arranged to face the first paper feeding tray at one side of the first paper feeding tray, and the first paper feeding roller and the second paper feeding roller are disposed to feed the print medium in a direction opposite to each other.

6. The paper feeding apparatus of claim 5, wherein a rotational direction of a rotational force that the first power transmission member transmits to the first one-way rotation transmission member is similar to a rotational direction of a rotational force that the second power transmission member transmits to the second one-way rotation transmission member.

7. The paper feeding apparatus of claim 5, wherein the second paper feeding tray comprises a manual paper feeding unit.

8. The paper feeding apparatus of claim 1, further comprising:

an idle roller disposed to be in contact with each of the first paper feeding roller and the second paper feeding roller and facing each of the first paper feeding roller and the second paper feeding roller.

9. The paper feeding apparatus of claim 1, wherein each of the first paper feeding roller and the second paper feeding roller comprises at least one of a pickup roller and a feed roller.

10. The paper feeding apparatus of claim 1, wherein each of the first power transmission member and the second power transmission member comprises one of a gear structure, a belt structure, and a mixed structure comprised of gears and a belt.

11. The paper feeding apparatus of claim 1, wherein the drive source comprises a motor capable of bi-directional rotation.

12. An image forming apparatus comprising:

a plurality of paper feeding trays configured to receive print media;

an image forming unit configured to form an image on the received print media;

at least one paper feeding apparatus configured to supply the image forming unit with a print medium received in one of the two adjacent paper feeding trays among the plurality of paper feeding trays; and a paper discharging unit configured to discharge the print medium on which an image is formed to an outside, wherein the at least one paper feeding apparatus comprises:

a first paper feeding roller disposed at a first paper feeding tray among the plurality of paper feeding trays, the first paper feeding roller configured to convey a print medium loaded in the first paper feeding tray, a first one-way rotation transmission member disposed coaxially on the first paper feeding roller to transmit a first one-way rotational force to the first paper feeding roller, a second paper feeding roller disposed at a second paper feeding tray adjacent to the first paper feeding tray among the plurality of paper feeding trays, the second paper feeding roller configured to convey a print medium loaded in the second paper feeding tray, a second one-way rotation transmission member disposed coaxially on the second paper feeding roller and configured to transmit a second one-way rotational force to the second paper feeding roller, a drive source configured to generate a rotational force to rotate the first paper feeding roller and the second paper feeding roller, a first power transmission member disposed between the first one-way rotation transmission member and the drive source, the first power transmission member configured to transmit power of the drive source to the first one-way rotation transmission member, and a second power transmission member disposed between the second one-way rotation transmission member and the drive source, the second power transmission member configured to transmit the power of the drive source to the second one-way rotation transmission member, and a conveying roller driven by the second power transmission member, wherein when the drive source rotates in a first direction, the first paper feeding roller conveys the print medium from the first paper feeding tray using the first one-way rotation transmission member, and when the drive source rotates in a direction opposite to the first direction, the second paper feeding roller conveys the print medium from the second paper feeding tray by the second one-way rotation transmission member.

13. The image forming apparatus of claim 12, wherein when a number of the plurality of paper feeding trays is 2N, where N is a natural number, a number of the drive sources of the plurality of paper feeding apparatuses is N.

14. The image forming apparatus of claim 12, wherein the plurality of paper feeding trays is disposed in a stacked structure in a vertical direction.

15. The image forming apparatus of claim 14, wherein a rotational direction of a rotational force that the first power transmission member transmits to the first one-way rotation transmission member is opposite a rotational direction of a rotational force that the second power transmission member transmits to the second one-way rotation transmission member.

16. The image forming apparatus of claim 12, wherein the plurality of paper feeding trays comprises a first paper feeding tray disposed inside a main body of the image forming apparatus and a second paper feeding tray disposed outside the main body facing the first paper feeding tray, and wherein the first paper feeding roller of the paper feeding apparatus is disposed to feed the print medium loaded in the first paper feeding tray, and the second paper feeding roller of the paper feeding apparatus is disposed to feed the print medium loaded in the second paper feeding tray.

17. The image forming apparatus of claim 16, wherein a rotational direction of a rotational force that the first power transmission member transmits to the first one-way rotation transmission member is similar to a rotational direction of a rotational force that the second power transmission member transmits to the second one-way rotation transmission member.

18. The image forming apparatus of claim 12, wherein the plurality of paper feeding trays comprises at least one pair of paper feeding trays in which two paper feeding trays are disposed to face each other, and the first paper feeding roller of the paper feeding apparatus is disposed to feed the print medium loaded in one pair of the at least one pair of paper feeding trays, and the second paper feeding roller of the paper feeding apparatus is disposed to feed the print medium loaded in another pair of the at least one pair of paper feeding trays.

19. The image forming apparatus of claim 12, wherein each of the first paper feeding roller and the second paper feeding roller comprises at least one of a pickup roller and a feed roller.

20. The image forming apparatus of claim 12, wherein each of the first power transmission member and the second power transmission member comprises one of a gear structure, a belt structure, and a mixed structure comprised of gears and a belt.

* * * * *